US011421447B2

(12) United States Patent
Roatis et al.

(10) Patent No.: US 11,421,447 B2
(45) Date of Patent: Aug. 23, 2022

(54) LOCK

(71) Applicant: TriTeq Lock and Security LLC, Elk Grove Village, IL (US)

(72) Inventors: Calin Roatis, Long Grove, IL (US); William Denison, North Barrington, IL (US)

(73) Assignee: TriTeq Lock and Security, LLC, Elk Grove Village, IL (US)

( * ) Notice: Subject to any disclaimer, the term of this patent is extended or adjusted under 35 U.S.C. 154(b) by 982 days.

(21) Appl. No.: 15/687,337

(22) Filed: Aug. 25, 2017

(65) Prior Publication Data

US 2017/0356219 A1 Dec. 14, 2017

Related U.S. Application Data

(63) Continuation of application No. PCT/US2016/019495, filed on Feb. 25, 2016.
(Continued)

(51) Int. Cl.
*E05B 47/06* (2006.01)
*E05B 47/00* (2006.01)
*E05B 65/46* (2017.01)

(52) U.S. Cl.
CPC ..... *E05B 47/0692* (2013.01); *E05B 47/0012* (2013.01); *E05B 47/0676* (2013.01); *E05B 65/46* (2013.01); *E05B 2047/0024* (2013.01)

(58) Field of Classification Search
CPC ..... E05B 47/0603; E05B 47/0676; E05B 47/0684; E05B 47/0692; E05B 47/0012;
(Continued)

(56) References Cited

U.S. PATENT DOCUMENTS 9,963,906 B2 * 5/2018 Roatis ..... E05B 47/0603
10,273,715 B2 * 4/2019 Roatis ..... E05B 47/0603
(Continued)

FOREIGN PATENT DOCUMENTS

EP 1903169 A2 * 3/2008 ..... E05B 47/0692
EP 2860331 A1 * 4/2015 ..... E05B 47/0692
WO WO-2005001224 A1 * 1/2005 ..... E05B 47/0692

OTHER PUBLICATIONS

Definition of the word "slot," https://www.merriam-webster.com/dictionary/slot (Year: 2021).*

*Primary Examiner* — Alyson M Merlino
(74) *Attorney, Agent, or Firm* — The Watson IP Group, PLC; Jovan N. Jovanovic

(57) ABSTRACT

A lock with a handle assembly and a lock articulating assembly. The handle assembly has a handle member and a lock assembly. The handle member has a central bore and a locking plug groove. The lock assembly has a lock arm with a body positionable within the central bore. The body includes a central bore and a radial bore which is alignable with the locking plug groove. The lock assembly further has an outward locking plug configured to translate along the radial bore and selectively into the locking plug groove. The lock articulating assembly includes a slider (or a second cam), an actuator, a cam coupled to a motor. The cam is selectively engageable with the slider to rotate and/or translate the slider. The actuator is coupled to the slider, so that movement to the slider imparts movement of the actuator.

13 Claims, 43 Drawing Sheets

Related U.S. Application Data

(60) Provisional application No. 62/120,674, filed on Feb. 25, 2015.

(58) Field of Classification Search
CPC ..... E05B 2047/0024; E05B 65/46; Y10T 70/5805; Y10T 70/5823; Y10T 70/5827; Y10T 70/7102; Y10T 70/7107; Y10T 70/713; Y10T 70/7751; Y10T 70/7949; Y10T 292/82; Y10T 292/85; Y10T 292/865; Y10T 292/876; Y10T 292/88; Y10T 292/93; Y10T 292/96; Y10T 292/14; Y10S 292/27
See application file for complete search history.

(56) References Cited

U.S. PATENT DOCUMENTS

| | | | | |
|---|---|---|---|---|
| 10,329,795 | B2 * | 6/2019 | Roatis | E05B 47/0012 |
| 10,550,600 | B2 * | 2/2020 | Roatis | E05B 47/0603 |
| 10,753,123 | B2 * | 8/2020 | Roatis | E05B 47/0603 |
| 2005/0050928 | A1 * | 3/2005 | Frolov | E05B 47/068 70/223 |
| 2015/0240528 | A1 * | 8/2015 | Mani | E05B 47/0603 70/278.1 |

* cited by examiner

LOCK

CROSS-REFERENCE TO RELATED APPLICATION

This application is a continuation of PCT International Patent Application Serial No. PCT/US2016/019495 filed Feb. 25, 2016, entitled "Lock" which claims priority from U.S. Provisional Patent Application Ser. No. 61/120,674 filed Feb. 25, 2015, entitled "Lock". The entire disclosure of each of these applications is incorporated by reference in their respective entireties.

BACKGROUND OF THE DISCLOSURE

1. Field of the Disclosure

The disclosure relates in general to locks, and more particularly, to a lock that is configured to provide electronic locking and unlocking of a lock. The lock relies upon a motor that moves a slider (or second cam) by way of a cam to direct an actuator into at least two different positions, one of which may be a locked position and one of which may be an unlocked position.

The present application incorporates, by reference, each one of the following referenced applications, namely, U.S. patent application Ser. No. 14/719,218, filed May 21, 2015, entitled "Lock" which is a continuation of PCT Patent Application Number PCT/US2014/038016 filed May 14, 2014, entitled "Lock" which claims priority from U.S. Provisional Patent Application Ser. No. 61/823,685 filed May 15, 2013, entitled "Hybrid-Electronic Core Lock."

2. Background Art

Many cabinets, desks, and other storage applications utilize locks that include a shell mounted on the door, drawer or cabinet, and an insertable and removable lock core that plugs into the shell. The shell not only houses the core, but also attaches to a driver for accomplishing the locking and unlocking function when rotated. The lock core acts to lock the driver in place when there is no key inserted in the lock core due to lock core tumblers that protrude into the shell to restrict the lock core and driver from rotation. Often, these locks have a rotatable handle to open and close the door, drawer or cabinet.

When the correct key is inserted in the lock core, the protruding tumblers move with respect to the cuts in the key blade and no longer protrude into the shell and no longer restrict rotation of the lock core. As the lock core is turned by the user rotating the key, the drive serves to drive a cam or locking bar to the unlocked position.

Such systems are ubiquitous, however, there are nevertheless drawbacks. For example, such systems typically have a vast number of different tumbler configurations, and corresponding keys associated with each such different tumbler configuration. As a result, a supplier must include a relatively large supply of spare locks, tumblers and keys to match those that are out in the field. Additionally, the removal and replacement of such locks (necessitated by the changing of the duty of a piece of furniture, dismissal of an employee, loss of a set of keys, etcetera) is very time consuming and labor intensive.

SUMMARY OF THE DISCLOSURE

The disclosure is directed to a lock comprising a handle assembly and a lock actuating assembly. The handle assembly includes a handle member and a lock assembly. The handle member has a central bore and a transverse groove extending outwardly from the central bore. The lock assembly includes a lock arm and at least one outward locking plug. The lock arm has a body and an actuator leg extending axially from the body. The body has a central bore with a radial bore extending outwardly therefrom. The body is positionable within the central bore of the handle member. The at least one outward locking plug is configured to travel along the radial bore of the lock arm and into the transverse groove of the handle member upon alignment of the radial bore and the transverse groove. The lock actuating assembly further includes an actuator, one of a slider and a second rotating cam, a cam and a motor. The actuator is positionable within the central bore of the body of the lock arm at least as far as the radial bore of the body of the lock arm, and positionable relative to the body of the lock arm between an unlocked and a locked configuration. In an unlocked configuration, the handle member and the lock arm rotate together, and in a locked configuration, the handle member is rotatable relative to the lock arm. The one of a slider and a second rotating cam is associated with the actuator, and configured to selectively direct the lock assembly between the locked and unlocked configuration, and having a cam profile. The cam has a first follower configured to intermittently coact with the cam profile to move the one of the slider and the second rotating cam so as to selectively direct the lock assembly between the locked and unlocked configuration. The cam is configured to continue rotating after the lock assembly reaches either one of the locked and unlocked configurations. The motor has an axle extending therefrom and is directly rotatably coupled to the cam so as to have the same axis of rotation. Actuation of the motor causes rotation of the axle and the cam.

In some configurations, the one of the slider and the second rotating cam comprises a slider, which is configured to slidably travel and to selectively slide the actuator within the central bore of the lock arm.

In some configurations, the actuator includes a proximal end and a distal end, with the proximal end affixed to the slider.

In some configurations, the actuator includes a proximal end and a distal end. The proximal end is slidably coupled to the slider such that the slider and the actuator have relative movement therebetween. A spring biases the actuator away from the slider.

In some configurations, the slider includes a cavity. The proximal end of the actuator is positioned within the cavity and configured to move relative to the slider across the cavity;

In some configurations, the at least one outward plug comprises a pair of outward plugs.

In some configurations, the pair of outward plugs each comprise a ball.

In some configurations, the one of a slider and a second rotating cam comprises the second rotating cam.

In some such configurations, the second rotating cam is affixed to the actuator.

In some configurations, the second rotating cam is roatatable relative to the actuator, with a biasing member coupling the second rotating cam and the actuator.

In some configurations, the one of a slider and a second rotating cam comprises a slider. The slider further includes a second cam profile disposed thereon. The cam further includes a second follower configured to engage the second cam profile.

In some configurations, the cam profile and the second cam profile are each substantially parallel to each other so as to define a longitudinal channel therebetween. The cam further includes a body having a first side and a second side. The first follower extends from the first side of the body, and the second follower extends from the second side of the body. The first follower interfaces with the cam profile, and the second follower interfaces with the second cam profile, with the body of the cam positioned at least partially within the longitudinal channel.

In some configurations, the longitudinal channel defines an axis of slidable movement of the slider.

In some configurations, the cam profile includes a first slot, a second slot and a third slot, with a first ridge defined between the first slot and the second slot, and a second ridge defined between the second slot and the third slot.

In some configurations, a width of the second slot is at least as wide as the first follower, such that when the first follower engages the second slot, further rotation thereof slidably moves the slider.

BRIEF DESCRIPTION OF THE DRAWINGS

The disclosure will now be described with reference to the drawings wherein.

DETAILED DESCRIPTION OF THE DISCLOSURE

Figure 1:
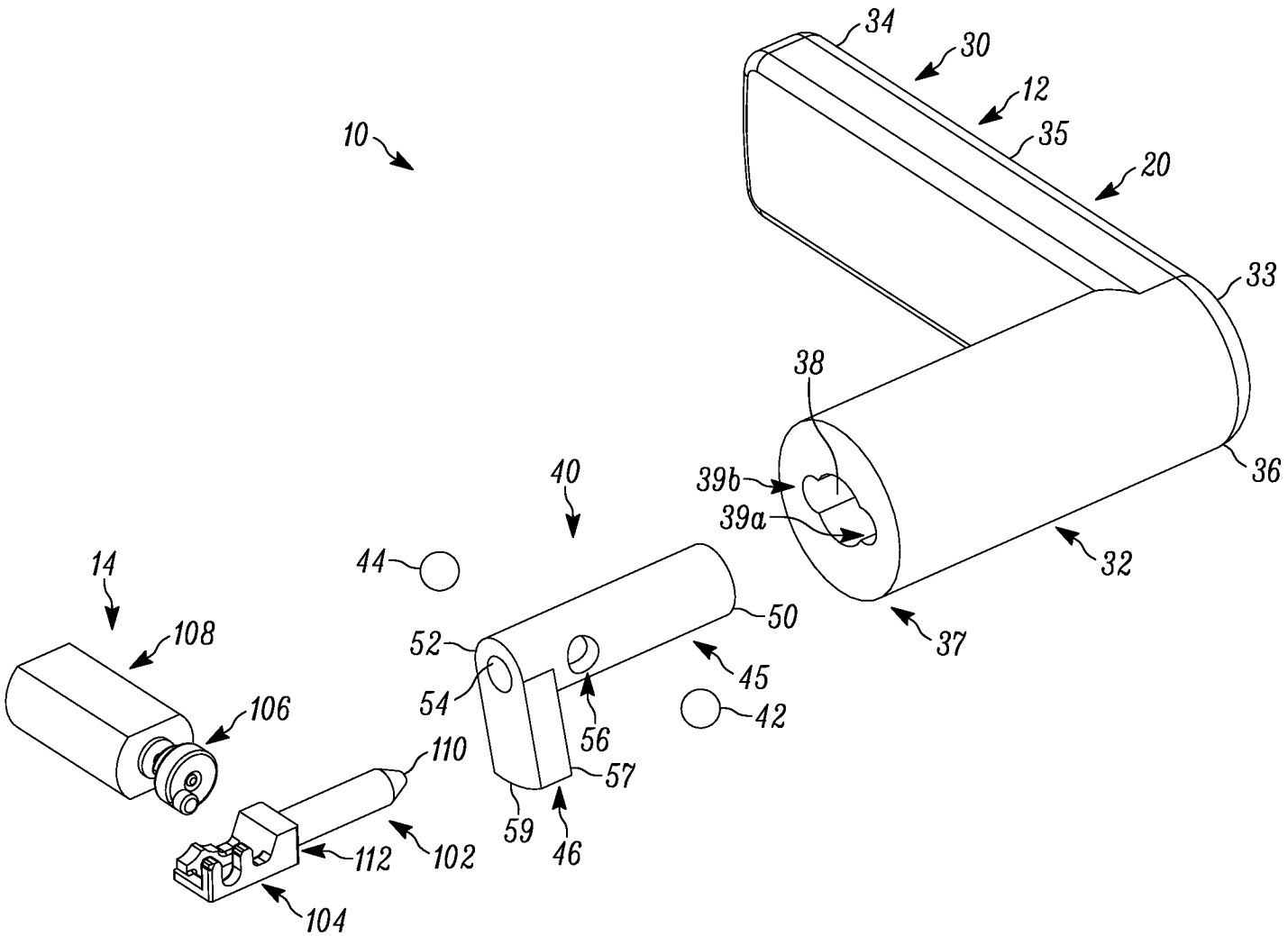
FIG. 1 of the drawings is an exploded perspective view of a configuration of the lock of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the lock of the present disclosure is shown generally at 10. The lock 10 may be utilized in a number of different environments and in association with a number of different installations, including but not limited to, doors, drawers, cabinets, pantries, desks, etc. Indeed, such a system is well suited for use on entry and office doors, as well as locking home doors and the like. It will be understood that the configuration is not limited to use in any particular application where locking is required. One particular use of the lock is in the office furniture application (i.e., desks, credenzas, cabinets, wardrobes, etc.), wherein it is contemplated that the lock can be a replacement for the commonly installed cabinet, locker room, chest locks which generally include a rotating lever, knob or the like. Of course, the disclosure is not limited to use in association with such applications.

Referring to FIGS. 1 through 7, the lock 10 is shown as including handle assembly 12 and actuating assembly 14. It will be understood that the door (or cabinet, or drawer) has been omitted as has the housing for the lock and the electronics associated with the motor and the control thereof. It will be understood that electronics may be utilized that correspond in operation to those disclosed in PCT Publication No. WO 2014/186471 A1 published to Roatis, et al., the entire specification of which is hereby incorporated by reference in its entirety, and which is in the chain of priority claimed. It will further be understood that a number of different housing configurations are contemplated, including those shown therein. For simplicity purposes, the present disclosure has omitted such items for pictorial clarity.

The handle assembly includes handle member 20 and lock assembly 22. The handle assembly, it will be understood, is accessible by a user to selectively lock or unlock the door or drawer. The handle member 20 includes lever grasping portion 30 and cylinder portion 32. The lever grasping portion 30 comprises a lever that extends substantially perpendicularly from the end of the cylinder portion. The lever grasping portion 30 includes proximal end 33, distal end 34 and outer surface 35. It will be understood that the handle is often (although not required) configured to be in one of a 3:00 and a 9:00 position (referred to as a three o'clock position or a nine o'clock position) and may be maintained in such an orientation through a spring or a detent, or a combination thereof, among other structures.

The cylinder portion 32 is generally integrally formed with the lever grasping portion 30, although variations are contemplated. The cylinder portion 32 includes outer end 36, inner end 37, central bore 38 and locking plug transverse grooves 39*a*, 39*b*. The central bore 38 generally extends about the axis of rotation of the handle member. Generally, the cylinder portion comprises a cylindrical member with the central bore extending therethrough. The cylinder portion includes the outer end 36 mating with the lever grasping portion 30, with the inner end 37 being positioned proximate the lock articulating assembly 14.

The central bore 38 extends from the inner end 37 of the cylinder portion toward the outer end 36. In the configuration shown, the central bore substantially matches the lock arm length so that the lock arm can extend, as will be explained, properly within the central bore 38. The locking plug grooves 39*a*, 39*b* extend transversely on either side of the central bore 38. In the configuration shown, the grooves extend from the inner end 37 toward the outer end 36, generally to a depth less than that of the central bore.

Figure 11:
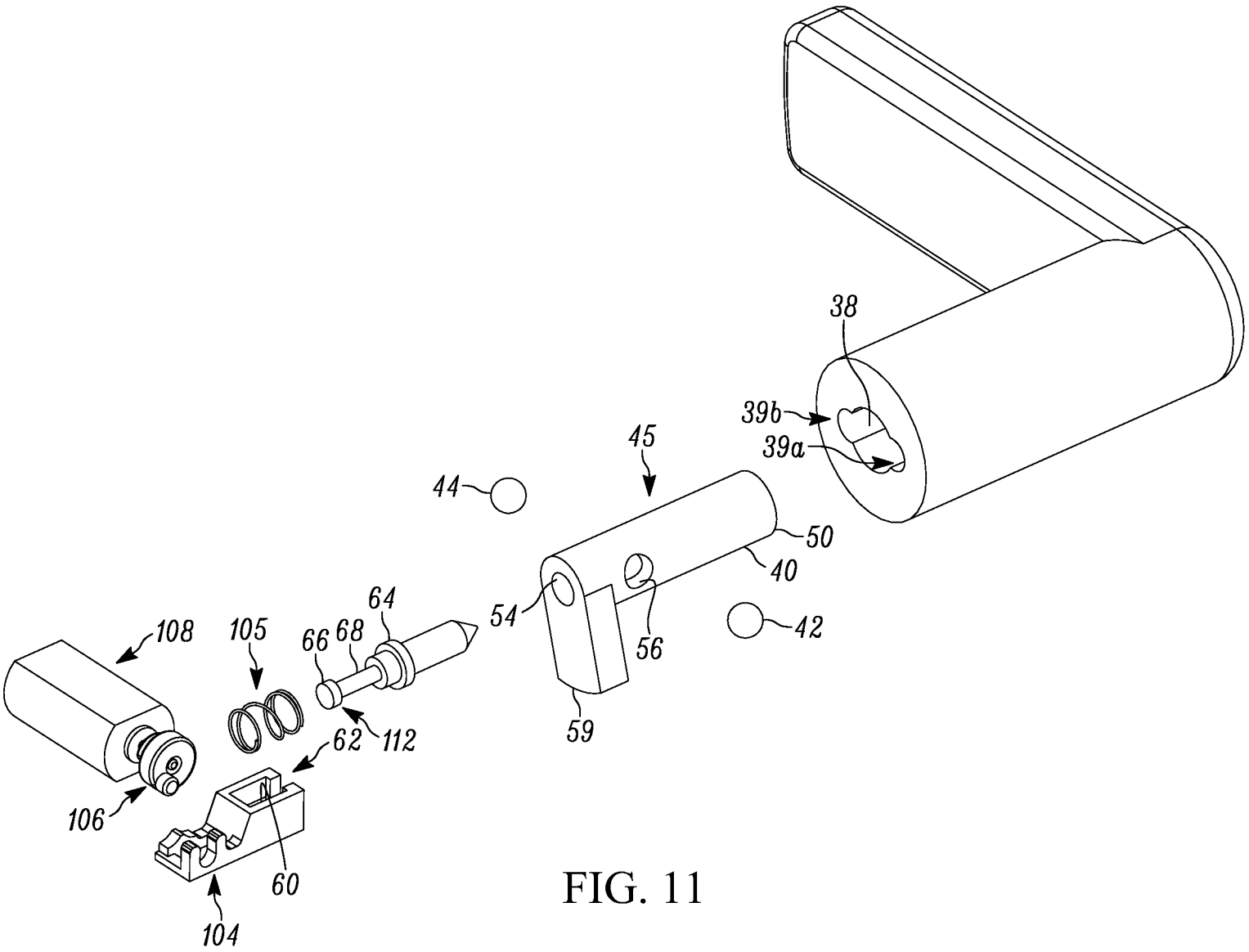
FIG. 11 of the drawings is an exploded perspective view of a second configuration of the lock of the present disclosure.
Figure 12:
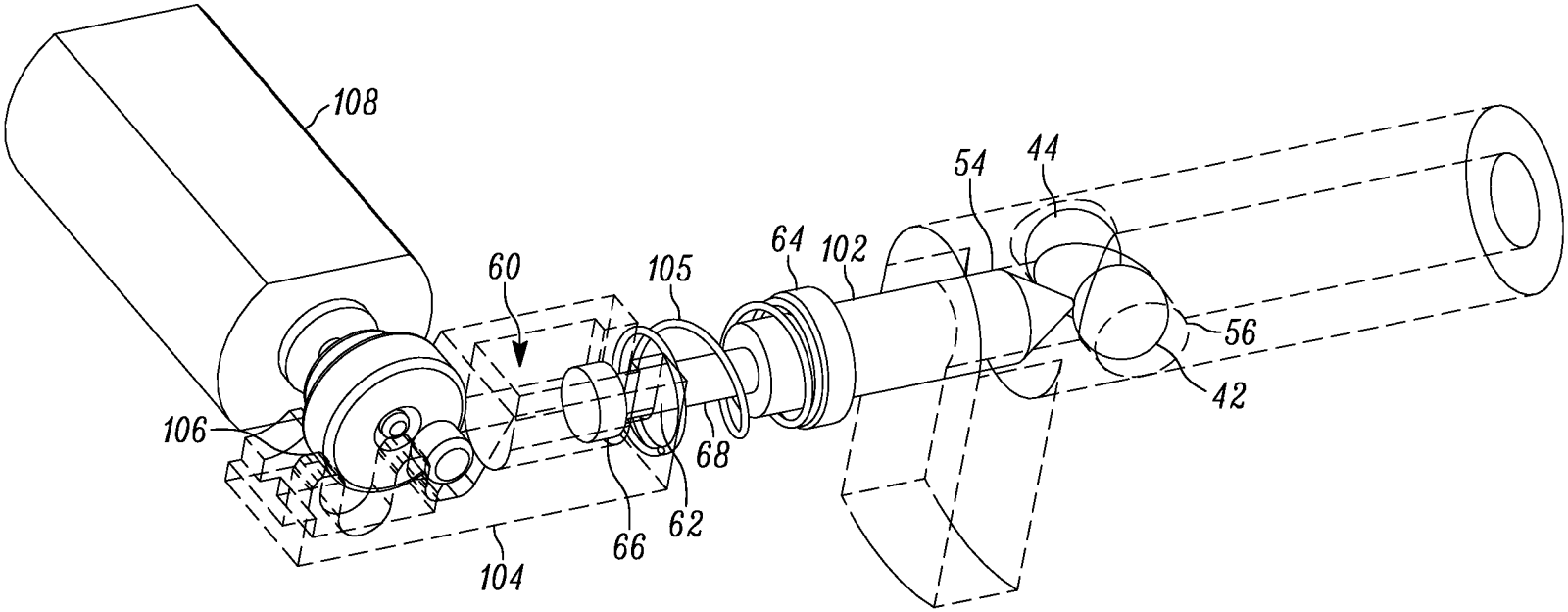
FIG. 12 of the drawings is a partial perspective view of a second configuration of the lock of the present disclosure, showing, in particular, the interaction of the lock assembly with the lock actuating assembly in a locked configuration.
Figure 13:
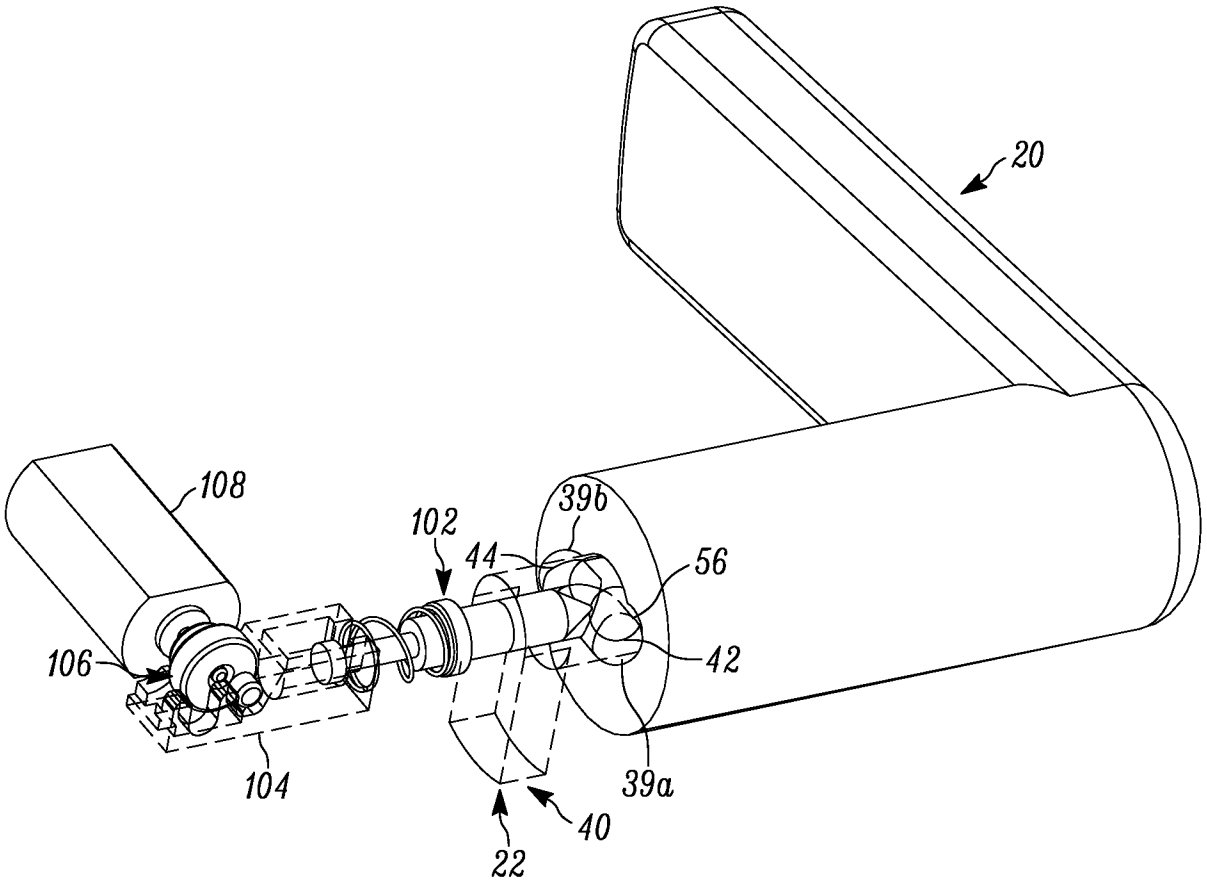
FIG. 13 of the drawings is a perspective view of a second configuration of the lock of the present disclosure, showing, in particular, the interaction of the lock assembly with the lock actuating assembly in a locked configuration, with the handle member being rotated relative to the lock assembly such that the locking plug grooves align with the radial bore.
Figure 14:
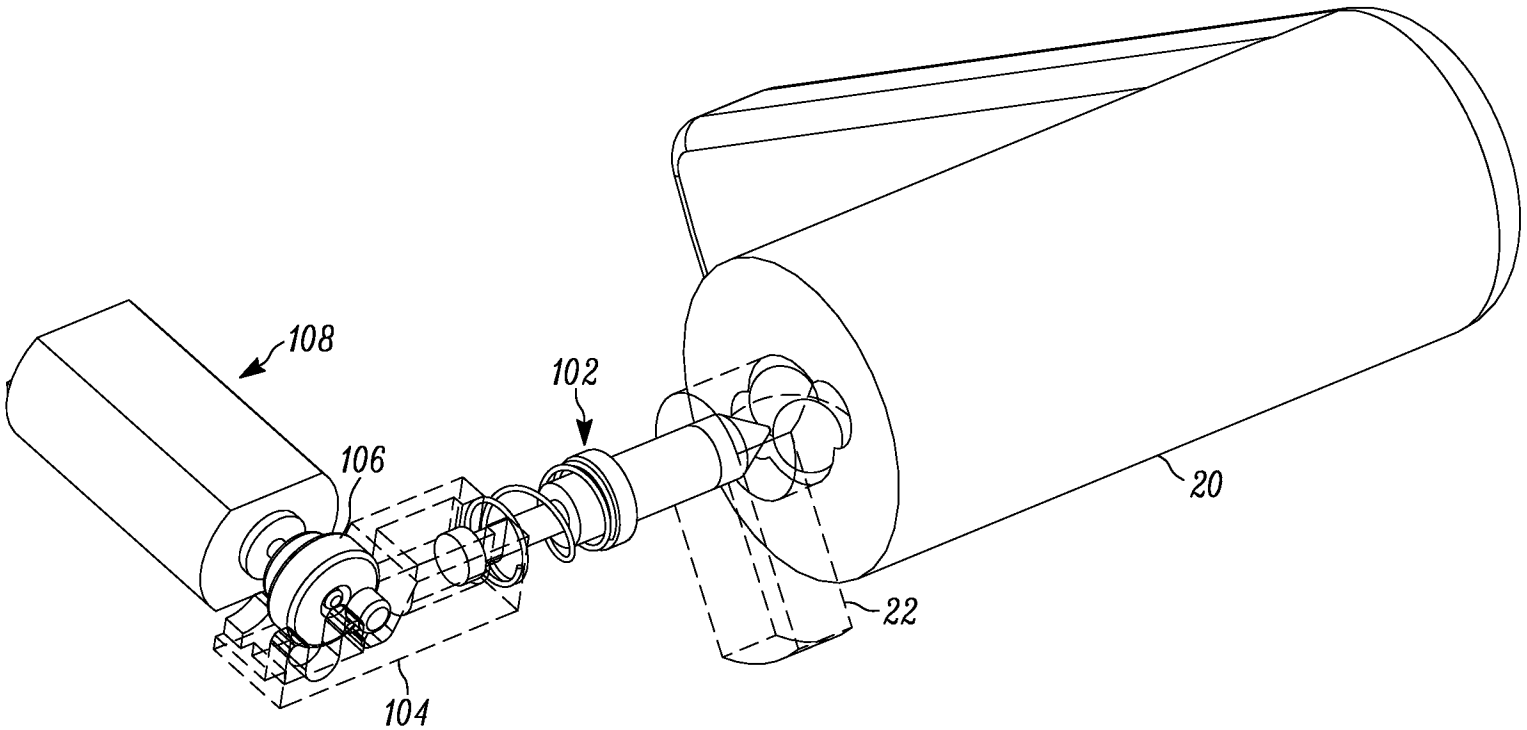
FIG. 14 of the drawings is a perspective view of a second configuration of the lock of the present disclosure, showing, in particular, the interaction of the lock assembly with the lock actuating assembly in a locked configuration, with the handle member being rotated relative to the lock assembly such that the locking plug grooves do not align with the radial bore.
Figure 15:
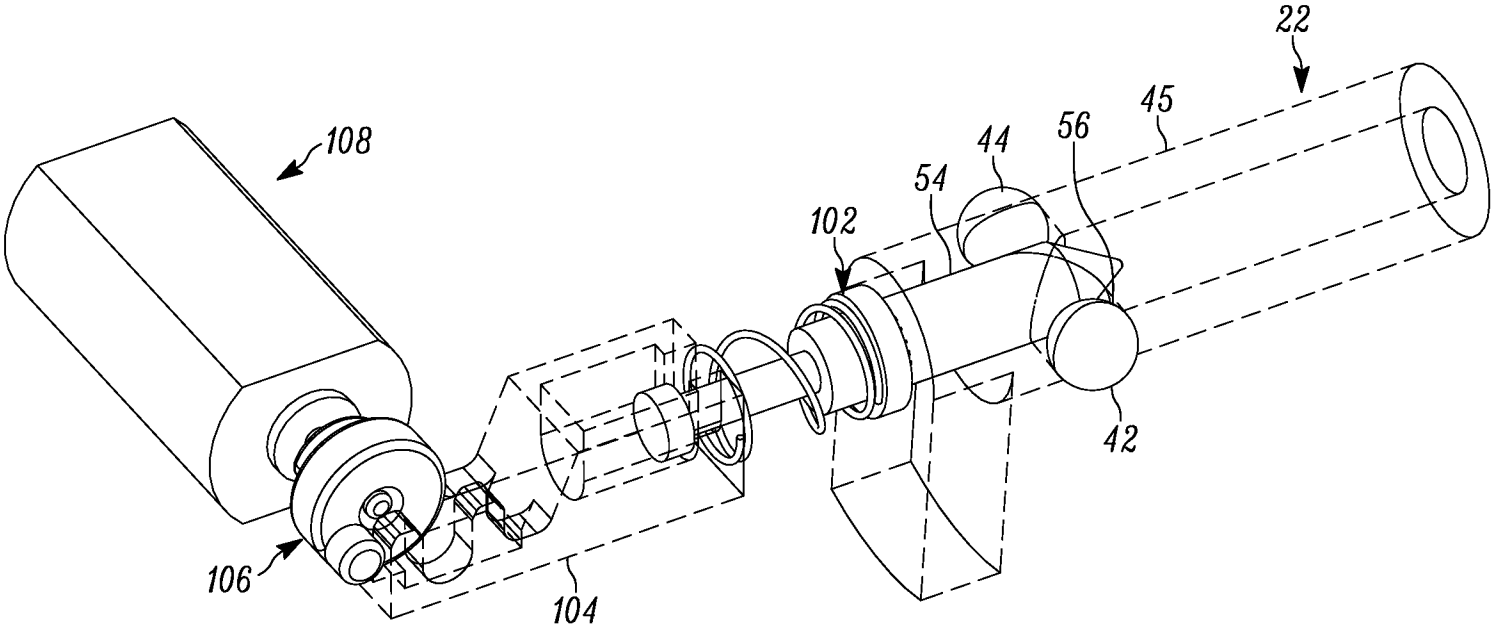
FIG. 15 of the drawings is a partial perspective view of a second configuration of the lock of the present disclosure, showing, in particular, the interaction of the lock assembly with the lock actuating assembly in a locked configuration.
Figure 16:
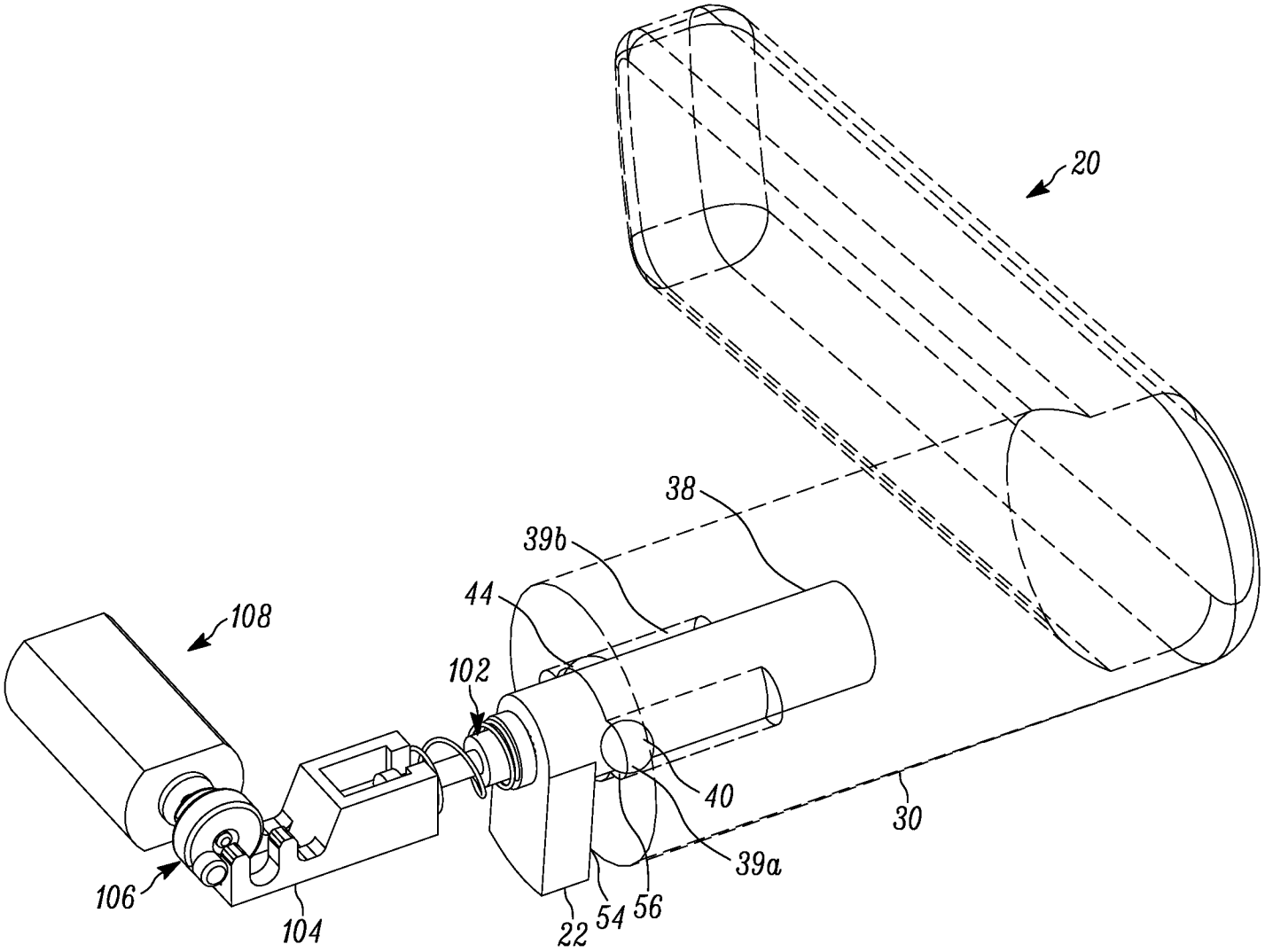
FIG. 16 of the drawings is a partial perspective view of a second configuration of the lock of the present disclosure, showing, in particular, the interaction of the lock assembly with the lock actuating assembly in an unlocked configuration, with the locking plug grooves aligning with the radial bore.
Figure 17:
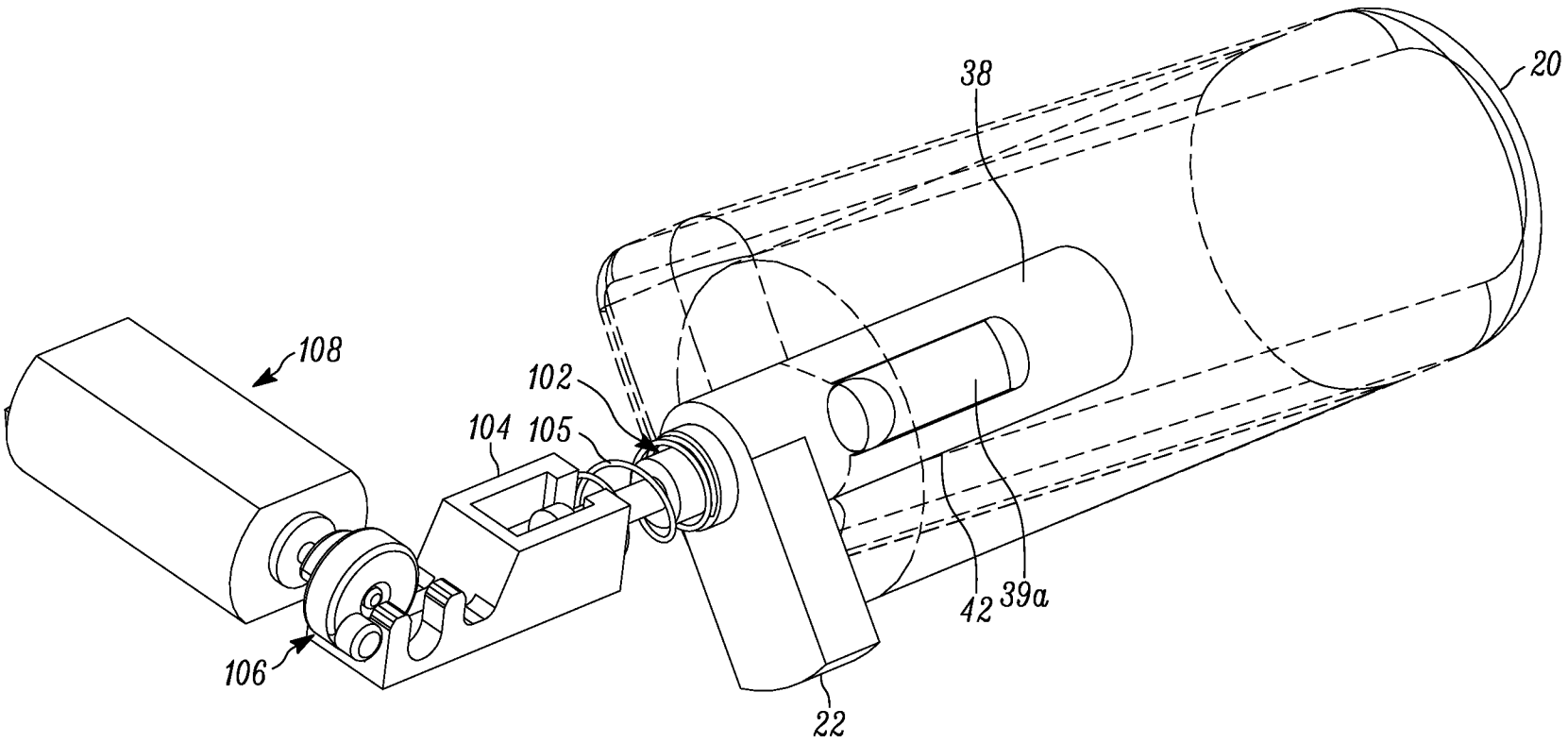
FIG. 17 of the drawings is a perspective view of a second configuration of the lock of the present disclosure, showing, in particular, the interaction of the lock assembly with the lock actuating assembly in an unlocked configuration, with the handle member and the lock assembly together being rotated in unison through the joining thereof by the first and second outward locking plugs (the balls)
Figure 18:
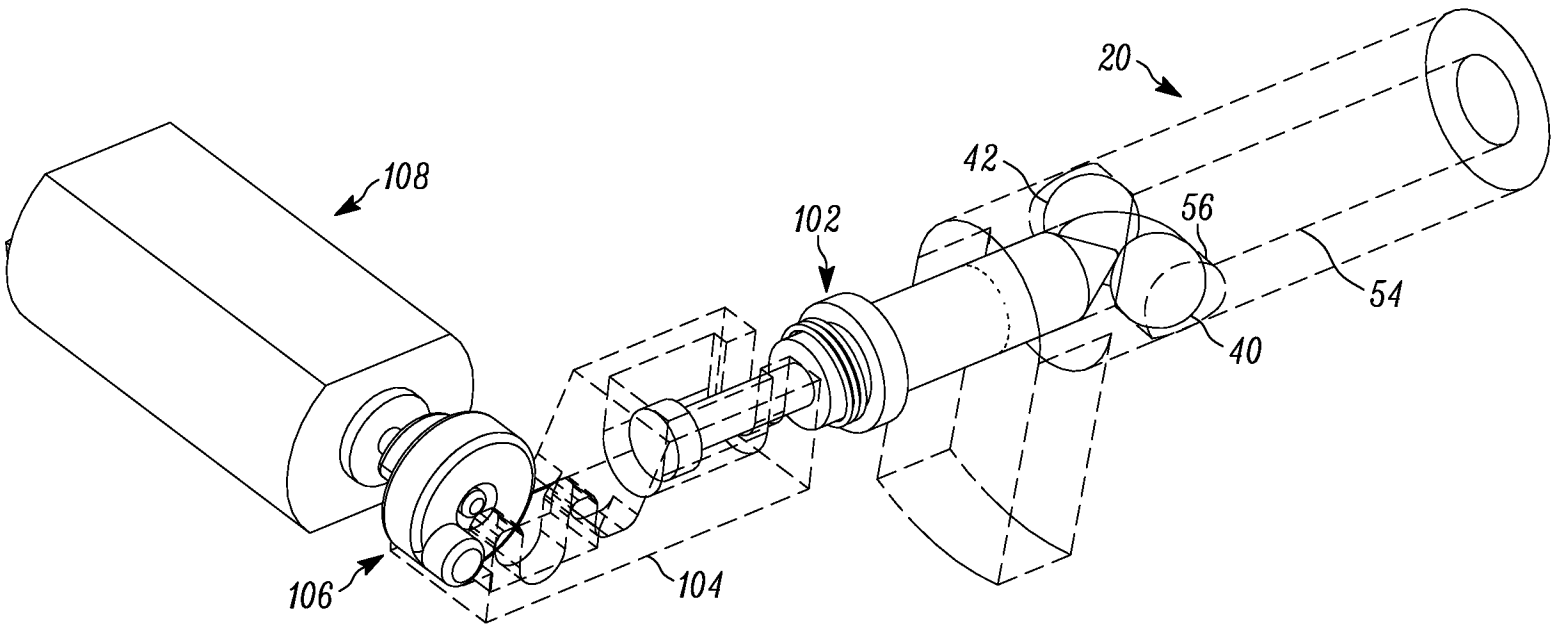
FIG. 18 of the drawings is partial perspective view of a second configuration of the lock of the present disclosure, showing, in particular, the interaction of the lock assembly with the lock actuating assembly, wherein the cam has moved the slider to the unlocked configuration, but the position of the balls and the relative misalignment of the locking plug grooves and the radial bore preclude movement of the actuator into the unlocked configuration.
Figure 19:
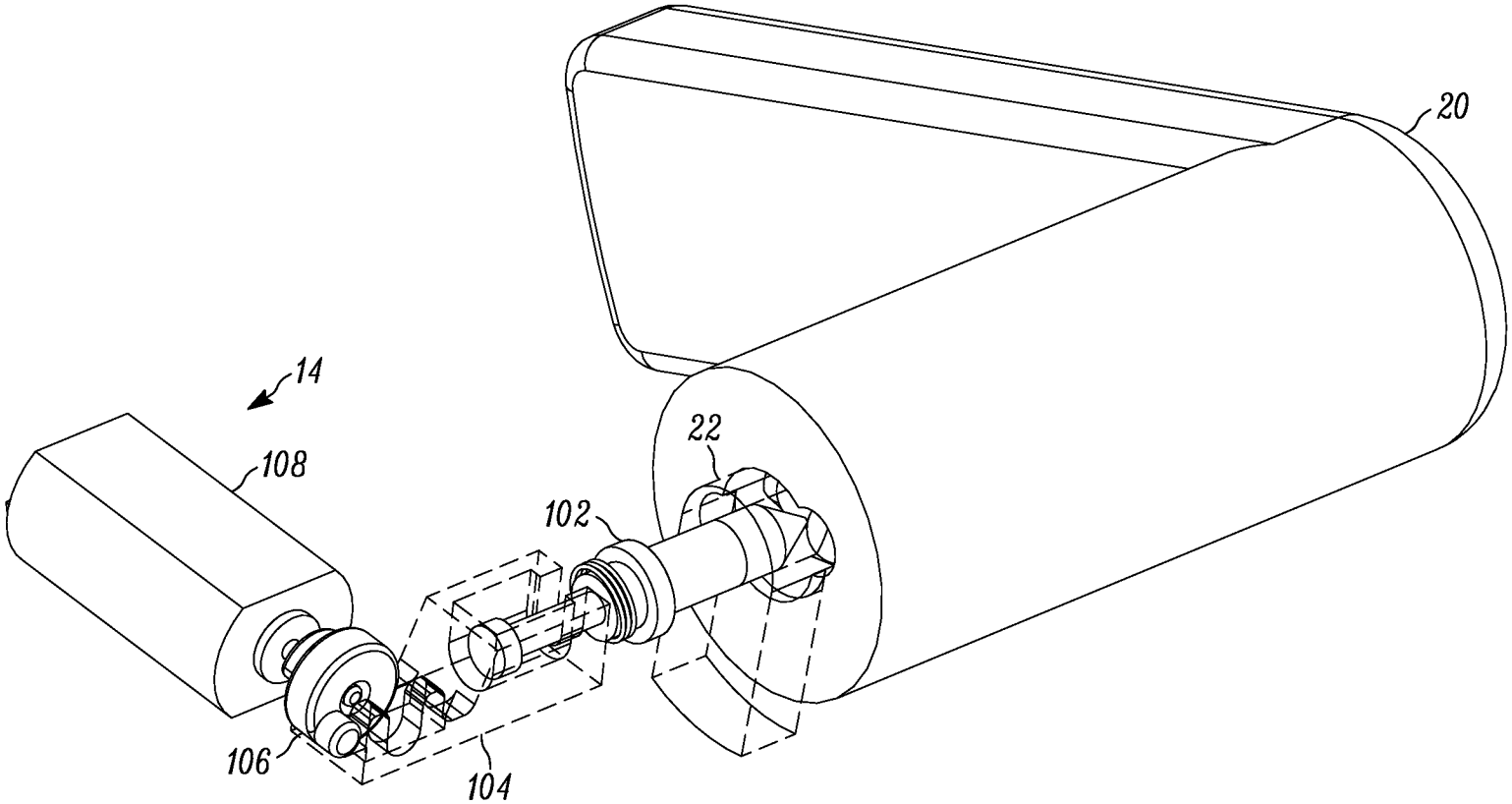
FIG. 19 of the drawings is a perspective view of a second configuration of the lock of the present disclosure, showing, in particular, the interaction of the lock assembly with the lock actuating assembly, wherein the cam has moved the slider to the unlocked configuration, but the position of the balls and the relative misalignment of the locking plug grooves and the radial bore preclude movement of the actuator into the unlocked configuration.
Figure 20:
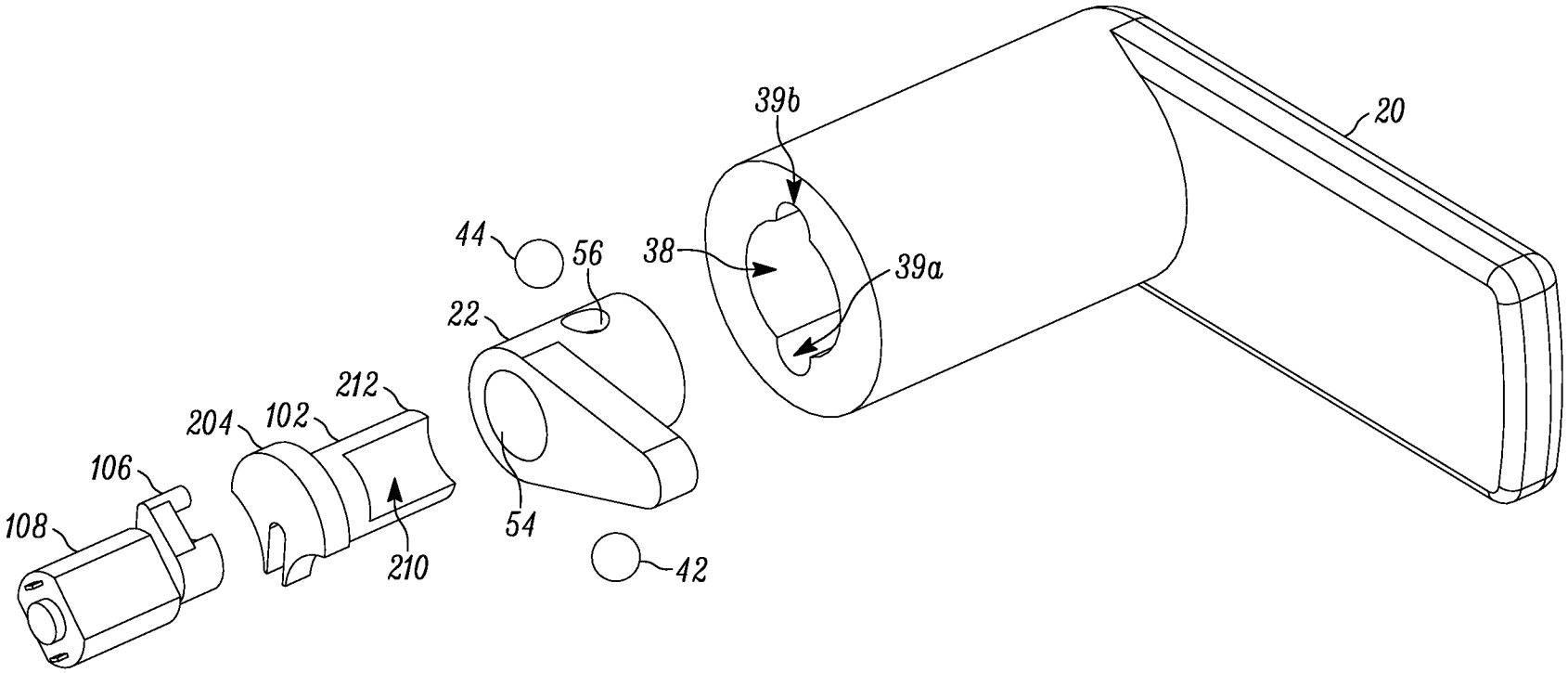
FIG. 20 of the drawings is an exploded perspective view of a third configuration of the lock of the present disclosure.
Figure 21:
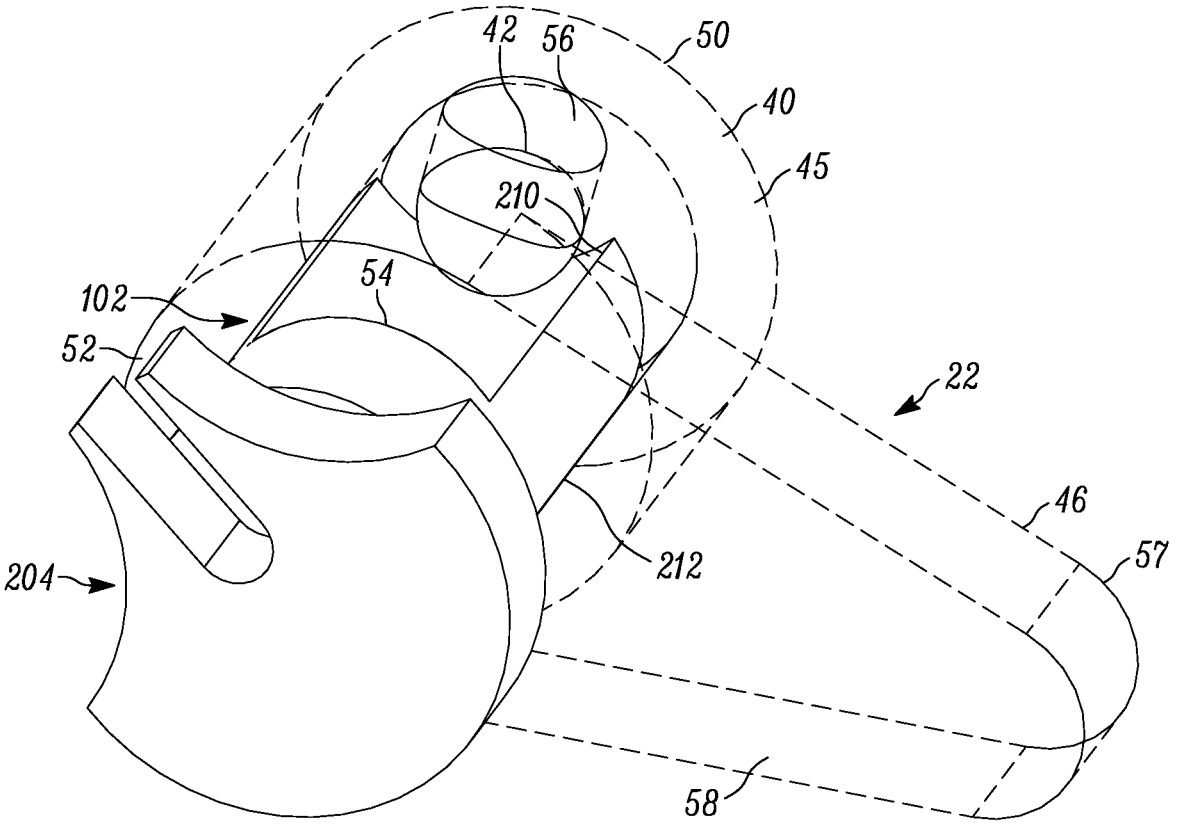
FIG. 21 of the drawings is a partial perspective view of the lock assembly and the second cam and actuator of the lock articulating assembly, showing, in particular, the position of the actuator such that the balls fall into the recessed portion of the actuator.
Figure 22:
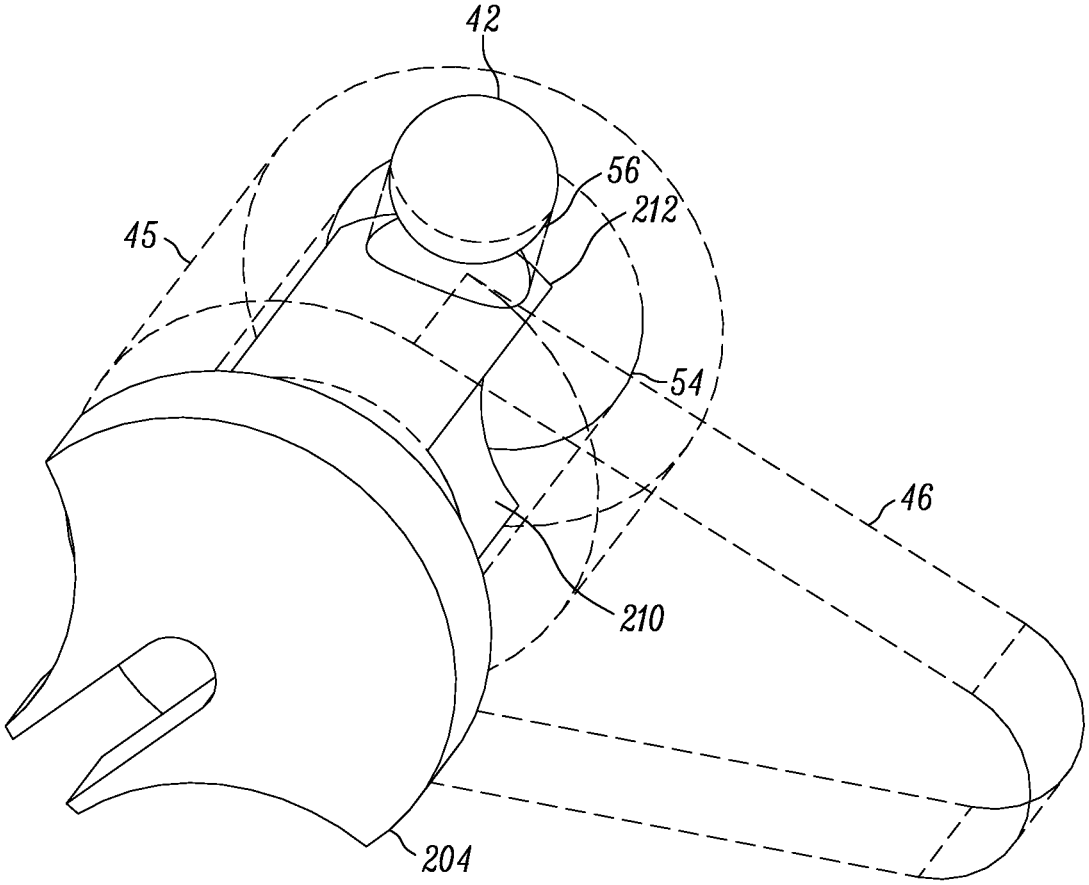
FIG. 22 of the drawings is a partial perspective view of the lock assembly and the second cam and actuator of the lock articulating assembly, showing, in particular, the position of the actuator such that the balls are directed outwardly and partially through the radial bore by the protruding portion of the actuator.
Figure 23:
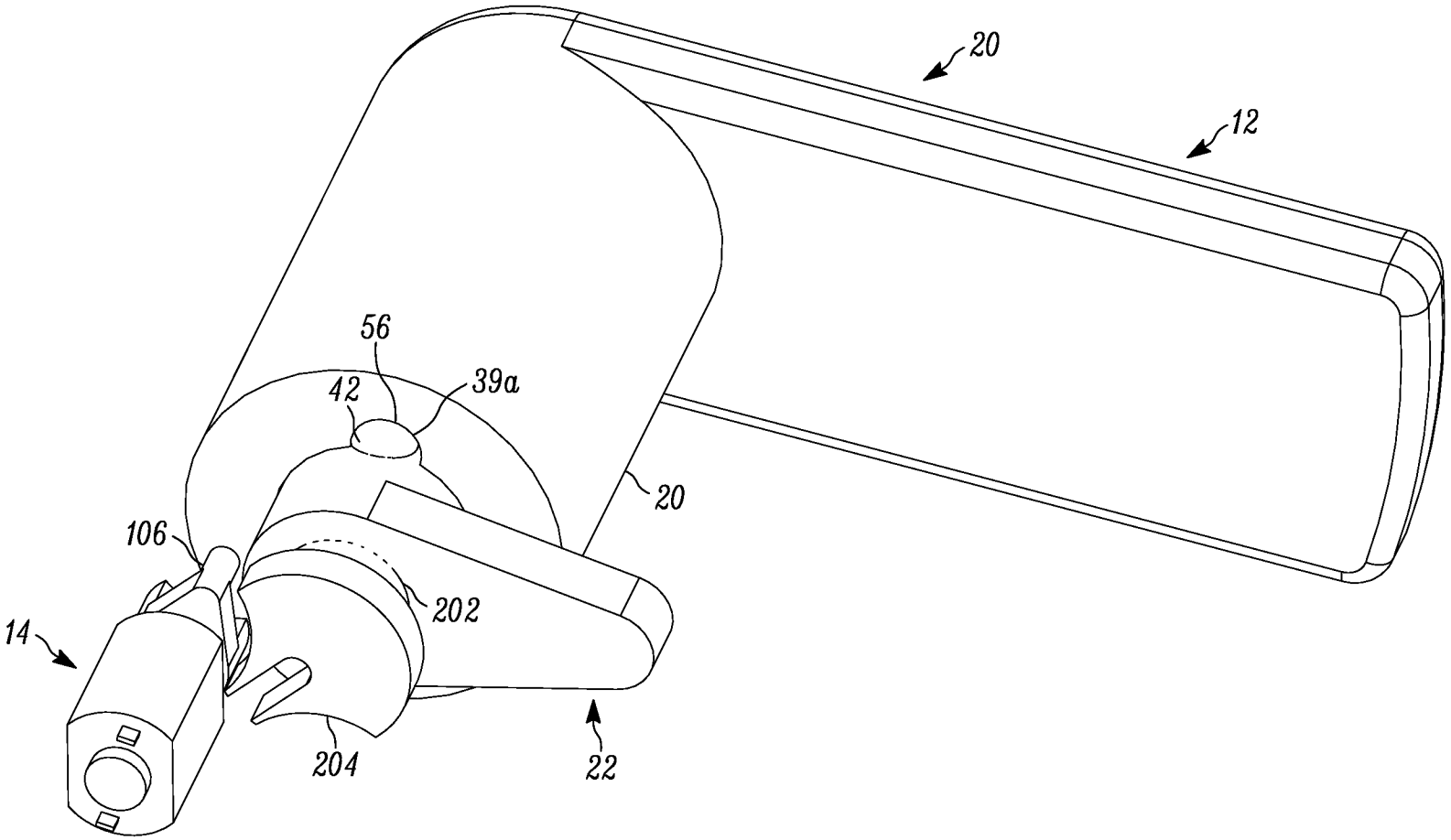
FIG. 23 of the drawings is a perspective view of a third configuration of the lock of the present disclosure, showing, in particular, the interaction of the lock assembly with the lock actuating assembly, wherein the lock is in an unlocked configuration.

The locking assembly 22 (FIG. 11) is shown as comprising lock arm 40, first outward locking plug 42 and second outward locking plug 44. The locking arm includes body 45 and actuator leg 46. The body is generally cylindrical and configured to fit within the central bore 38 of the cylinder portion 32 of the handle member 20. The body 45 includes first end 50, second end 52, central bore 54 and radial bore 56. In the configuration shown, the central bore 54 has a central axis that corresponds to the central axis of the central bore within which the body 45 is positioned. That is the bores are substantially concentric such that relative rotation is achieved along the same axis of rotation.

Radial bore 56 extends transverse across the body 45 at a point between the first and second end thereof. In the embodiment shown, the radial bore 56 is generally perpendicular to the central bore 54 and generally the central axis of each intersects with the axis lying in the same plane, generally.

The actuator leg 46 is positioned at the second end 52 of the body 45 and includes inside surface 57 and outside surface 58. The actuator leg 46 extends from the lock arm in a transverse direction, and is generally perpendicular to the body 45 of the lock arm. In the configuration shown, the actuator leg extends from the body 45 such that the radial bore 56 extends on either side thereof, and is equally spaced apart therefrom. That is, the actuator leg is perpendicular to the central axis of the radial bore. Additionally, when the lock arm is inserted into the central bore 38 of the handle member, the radial bore 56 matches the locking plug grooves 39*a*, 39*b* so that when the lock arm is rotated to a particular orientation, these structures correspond.

The first outward locking plug 42 and the second outward locking plug 44 are both shown in FIG. 1 as comprising a ball (and will often times be referred herein as a ball or the balls, with the understanding that other structures such as cylinders among others are contemplated as well). The ball is configured to slidably move within the radial bore 56 and the locking plug grooves 39*a*, 39*b* as directed. The cross-section of the locking plug grooves 39*a*, 39*b* is such that the ball can extend partially out of the radial bore of the locking arm and into the locking plug groove, however, at least a portion of the ball remains within the radial bore 56. It will be understood that when the balls are directed into the locking plug grooves 39*a*, 39*b*, while remaining partially within the radial bore, the lock arm and the handle member are precluded from relative rotation, and instead rotate as a single unit. On the other hand, when the balls are directed to be within the radial bore 56 (which is sized so as to be able to fully receive both at the same time), the lock arm 40 is freely rotatable relative to the handle member.

In other configurations, the outward locking plugs 42, 44 may comprise other configurations which can be selectively extended outwardly into the locking plug grooves, and can be selectively extended back inwardly into the radial bore. It is also contemplated that when the lock is in the locked configuration, the slider and actuator (or cam and actuator) can act to block the locking member at the same time it acts to disconnect the handle from being able to operate the lock member. Such a configuration would discourage manipulation of the lock from the outside by an unauthorized user.

Figure 2:
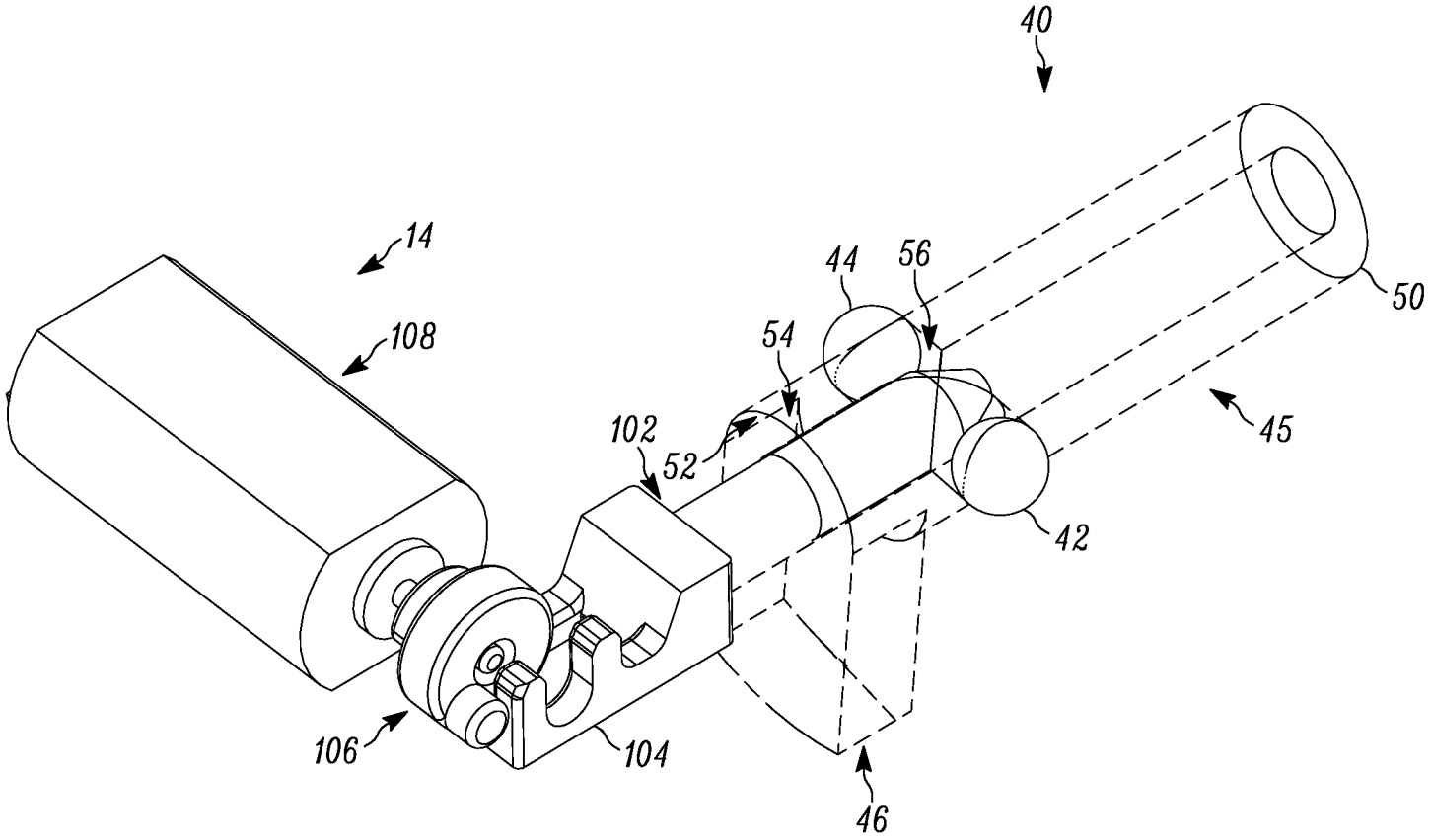
FIG. 2 of the drawings is a partial perspective view of a configuration of the lock of the present disclosure, showing, in particular, the interaction of the lock assembly with the lock actuating assembly in an unlocked configuration.
Figure 3:
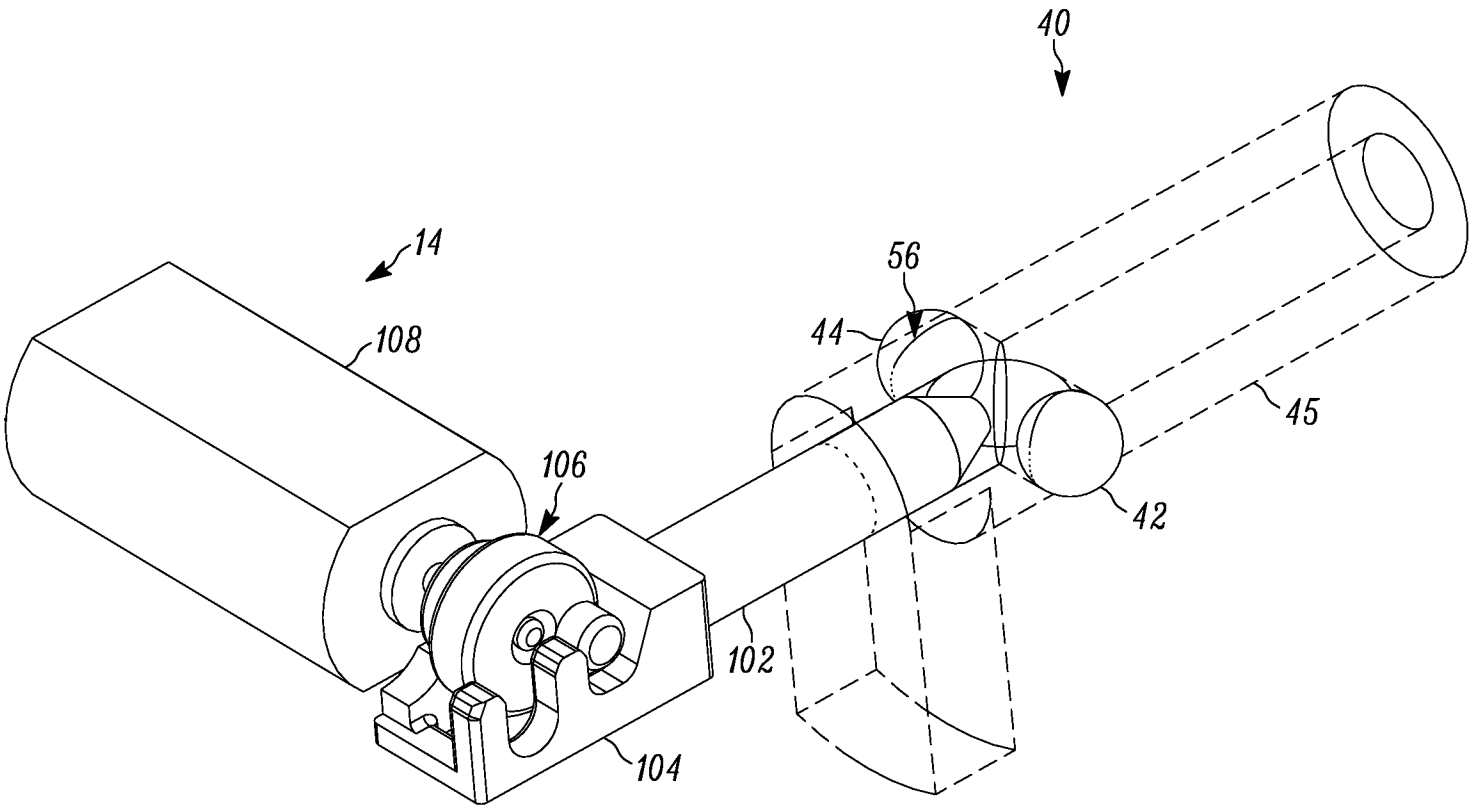
FIG. 3 of the drawings is a partial perspective view of a configuration of the lock of the present disclosure, showing, in particular, the interaction of the lock assembly with the lock actuating assembly in a locked configuration.
Figure 4:
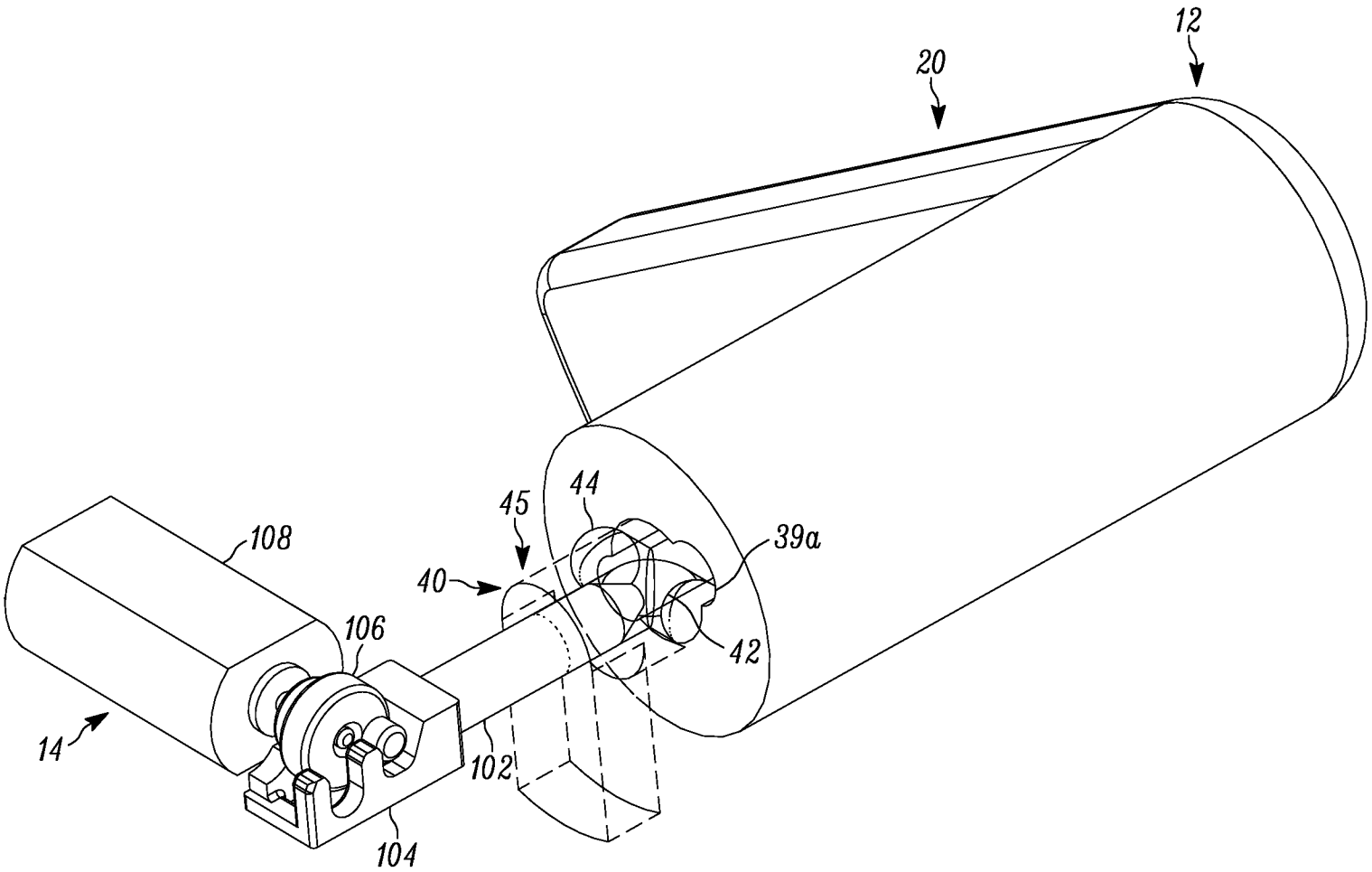
FIG. 4 of the drawings is a perspective view of a configuration of the lock of the present disclosure, showing, in particular, the interaction of the lock assembly with the lock actuating assembly in a locked configuration, with the handle member being rotated relative to the lock assembly such that the locking plug grooves do not align with the radial bore.
Figure 5:
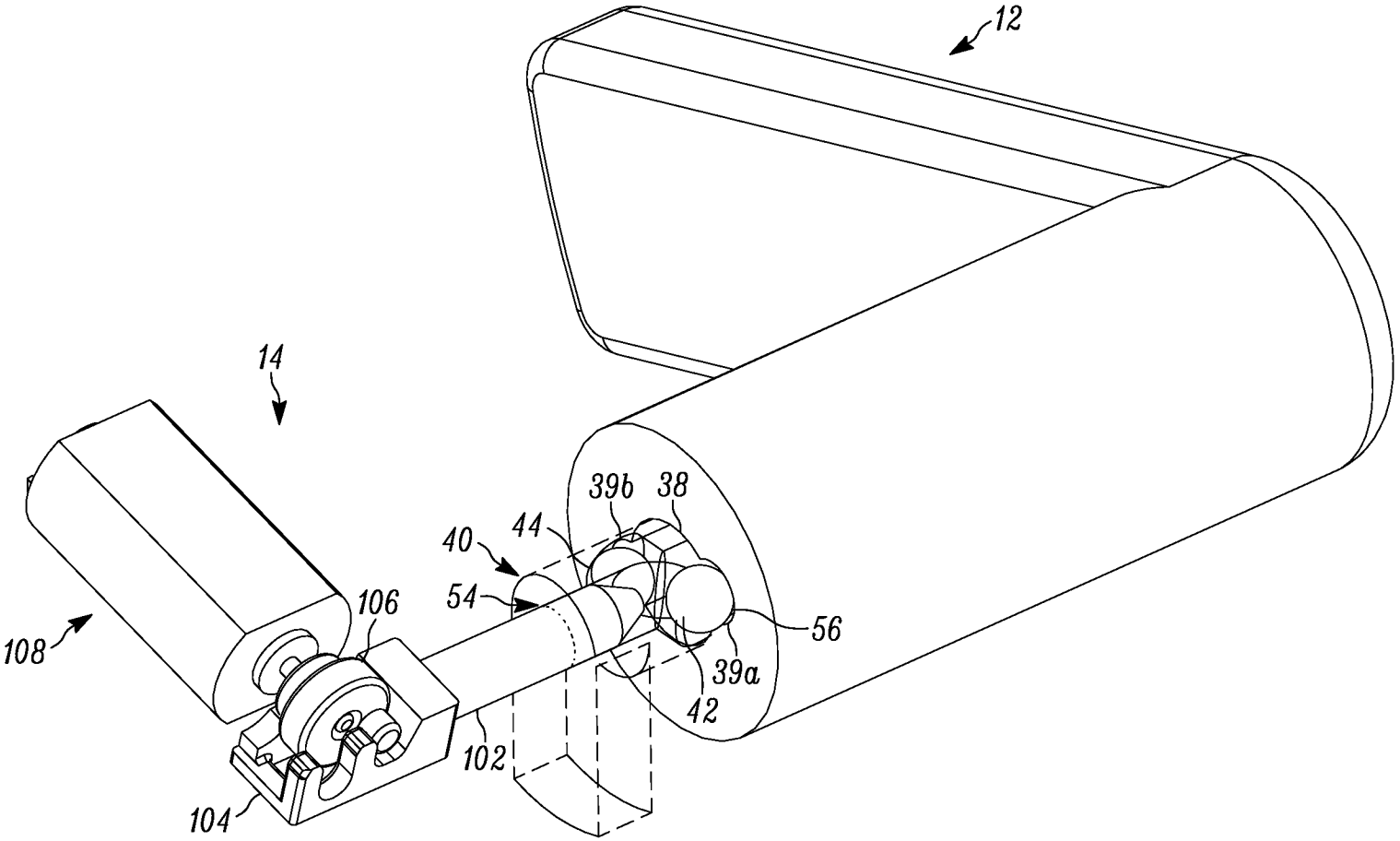
FIG. 5 of the drawings is a perspective view of a configuration of the lock of the present disclosure, showing, in particular, the interaction of the lock assembly with the lock actuating assembly in a locked configuration, with the handle member being rotated relative to the lock assembly such that the locking plug grooves align with the radial bore.
Figure 6:
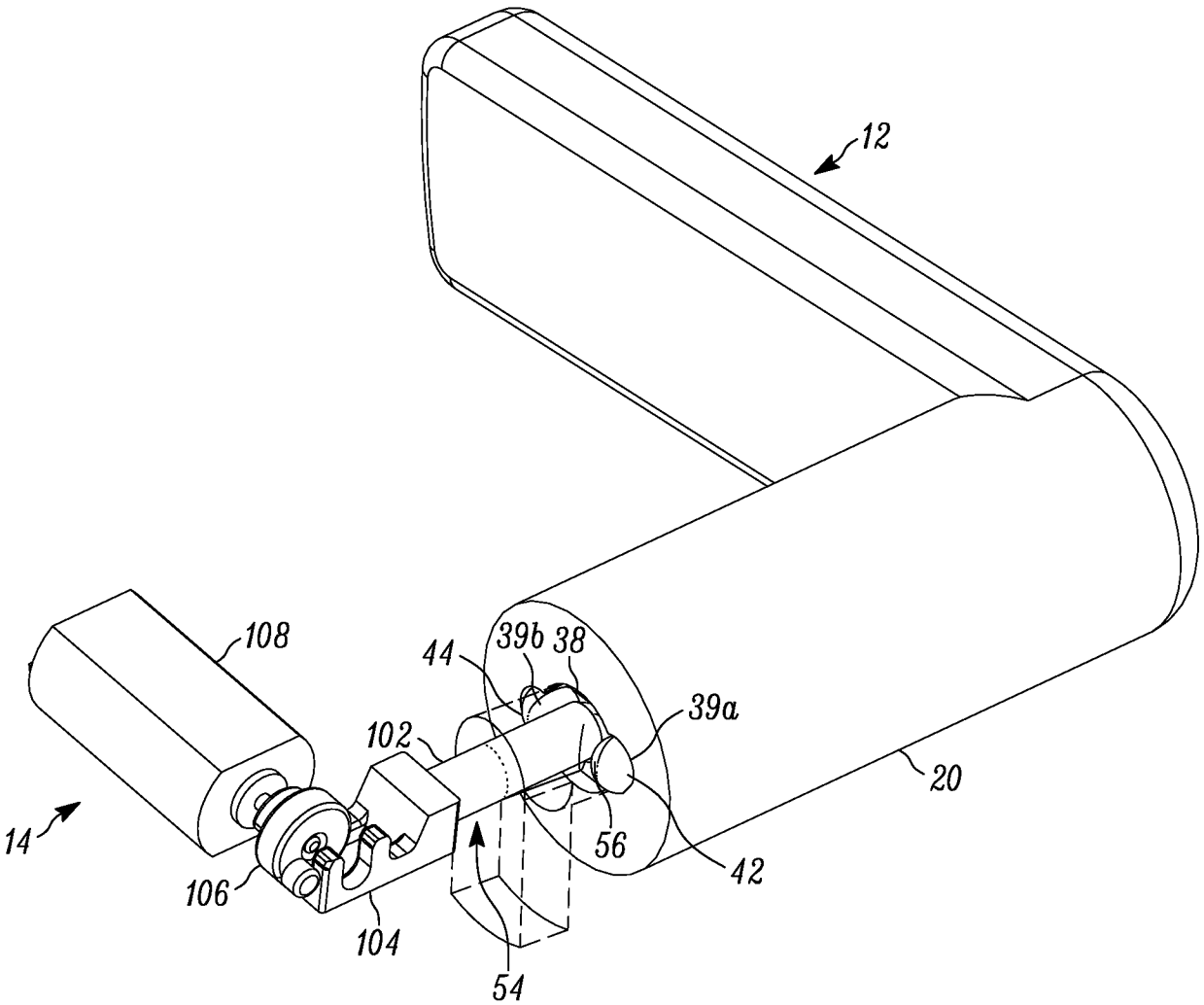
FIG. 6 of the drawings is a perspective view of a configuration of the lock of the present disclosure, showing, in particular, the interaction of the lock assembly with the lock actuating assembly in an unlocked configuration, with the locking plug grooves aligning with the radial bore.
Figure 7:
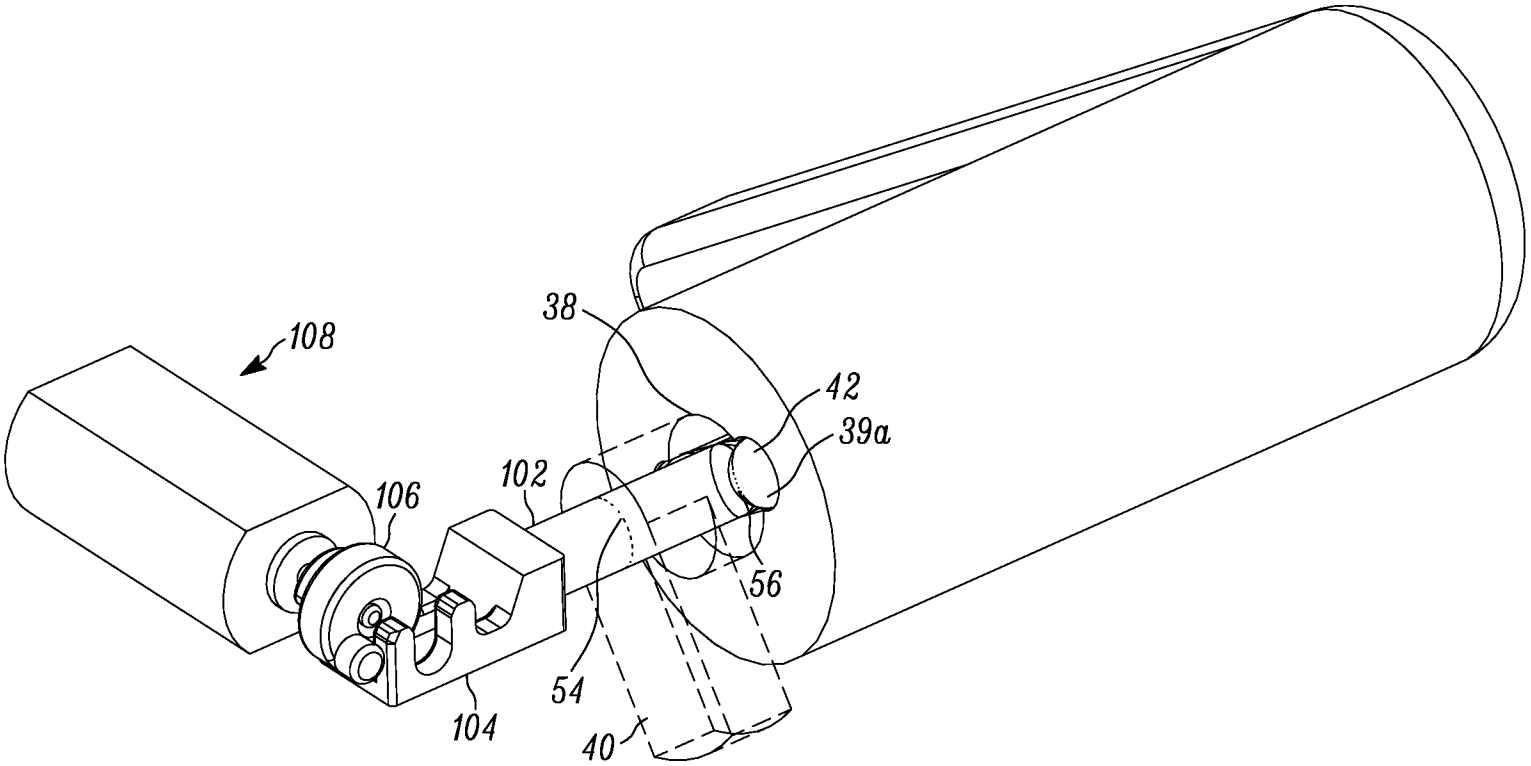
FIG. 7 of the drawings is a perspective view of a configuration of the lock of the present disclosure, showing, in particular, the interaction of the lock assembly with the lock actuating assembly in an unlocked configuration, with the handle member and the lock assembly together being rotated in unison through the joining thereof by the first and second outward locking plugs (the balls)

The lock articulating assembly 14 is shown as comprising actuator 102, slider 104, cam 106 and motor 108. It will be understood that FIGS. 3, 4 and 5 show the slider in the locked position, and, that FIGS. 2, 6 and 7 show the slider in the unlocked position. The actuator 102 includes proximal end 110 and distal end 112. In the configuration shown, the proximal end 112 is coupled to the slider 104 so as to be integrally formed. In the unlocked position, and as will be explained, the distal end 112 of the actuator 102 extends into the central bore 54 of the body 45 so as to outwardly direct the first and second outward locking plugs 42, 44 into the locking plug grooves 39*a*, 39*b*. In some embodiments, a number of different mechanisms may be utilized for monitoring the position of the actuator and/or slider.

Figure 9A:
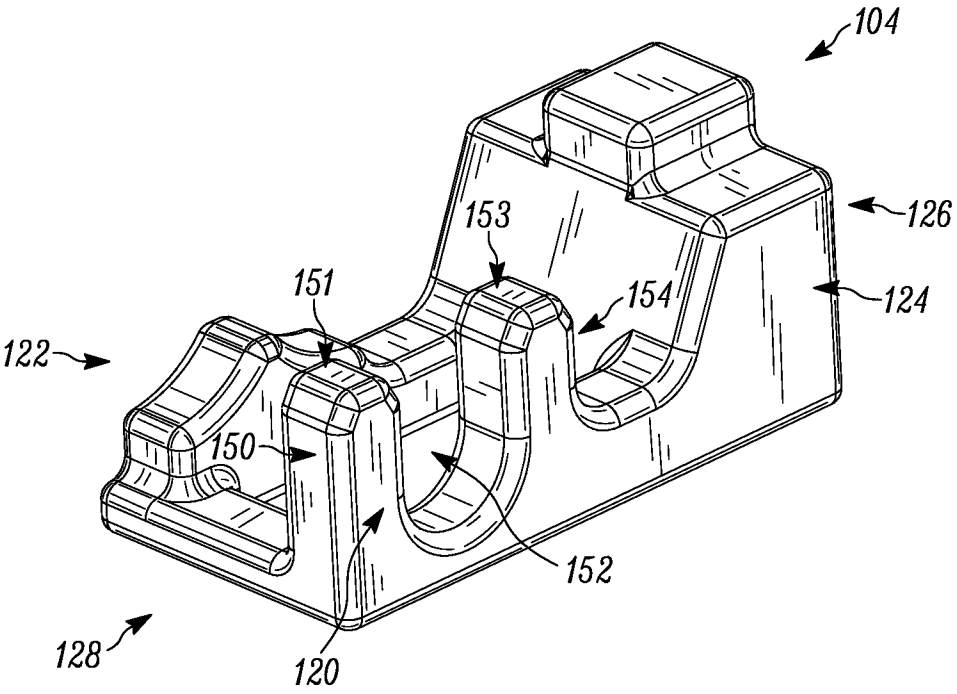
FIG. 9A of the drawings is a front perspective view of the slider of the present disclosure.
Figure 9B:
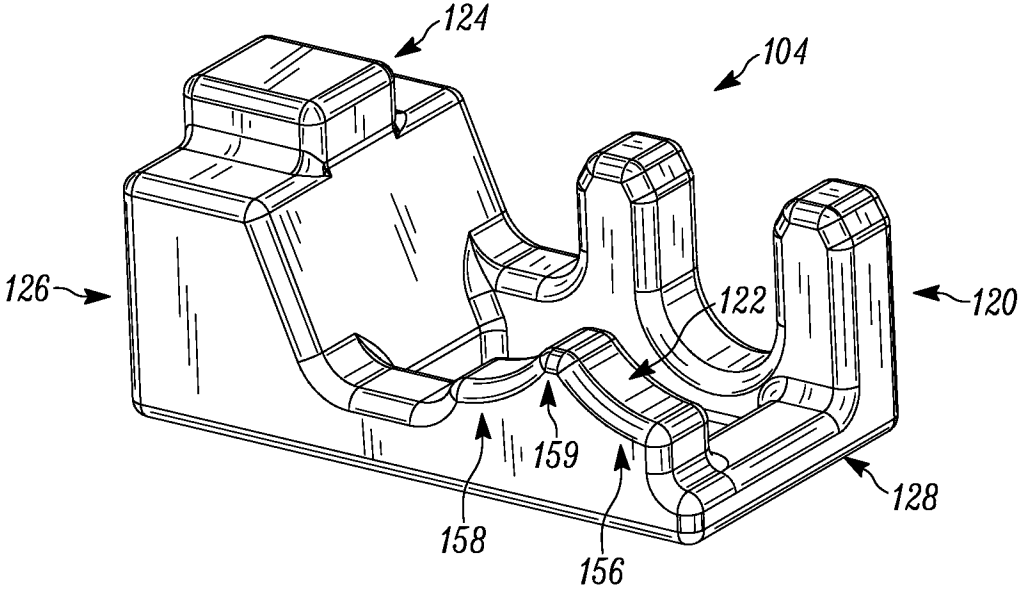
FIG. 9B of the drawings is a back perspective view of the slider of the present disclosure.

With reference to FIGS. 9A and 9B, the slider 104 is shown as comprising first cam profile 120, second cam profile 122, actuator engagement body 124. The actuator engagement body 124 is positioned at an end 126) of the slider 104. The first cam profile 120 extends between the first end 128 and the actuator engagement body 124. Similarly the second cam profile 122 extends between the first end 128 and the actuator engagement body 124 in a generally parallel and spaced apart orientation from the first cam profile. The spaced apart orientation of the two cam profiles defines a longitudinal channel therebetween. It will be understood that the cam body rotatably extends through the longitudinal channel as the followers thereof interact with the first and second cam profiles.

The first cam profile 120 includes first slot 150, second slot 152, and third slot 154. A first ridge 151 is defined between the first slot 150 and the second slot 152. A second ridge 153 is defined between the second slot 152 and the third slot 154. In the embodiment shown, the first slot 150 is formed on the outside of the first ridge 151. The second cam profile 122 includes first ramp 156, second ramp 158 and peak 159 positioned therebetween. In the embodiment shown, the slider comprises a metal member, such as zinc or the like. Of course, other materials are contemplated.

Figure 8A:
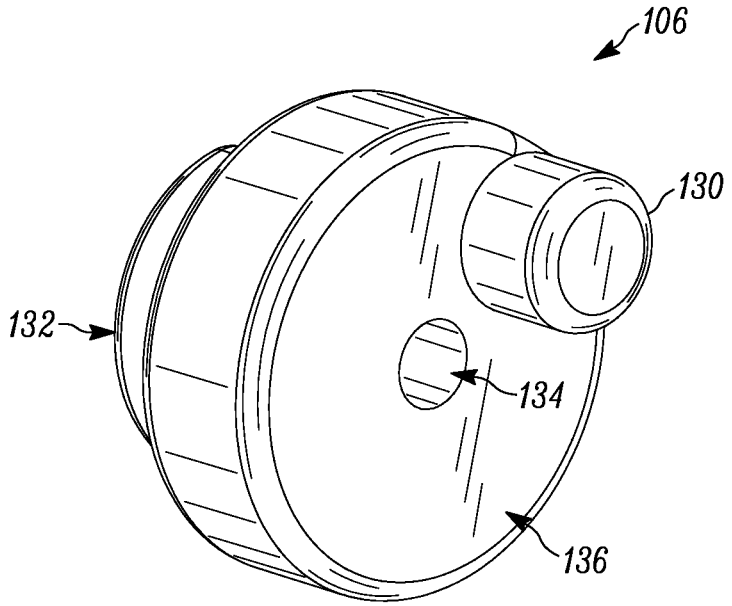
FIG. 8A of the drawings is a front perspective view of the cam of the present disclosure.
Figure 8B:
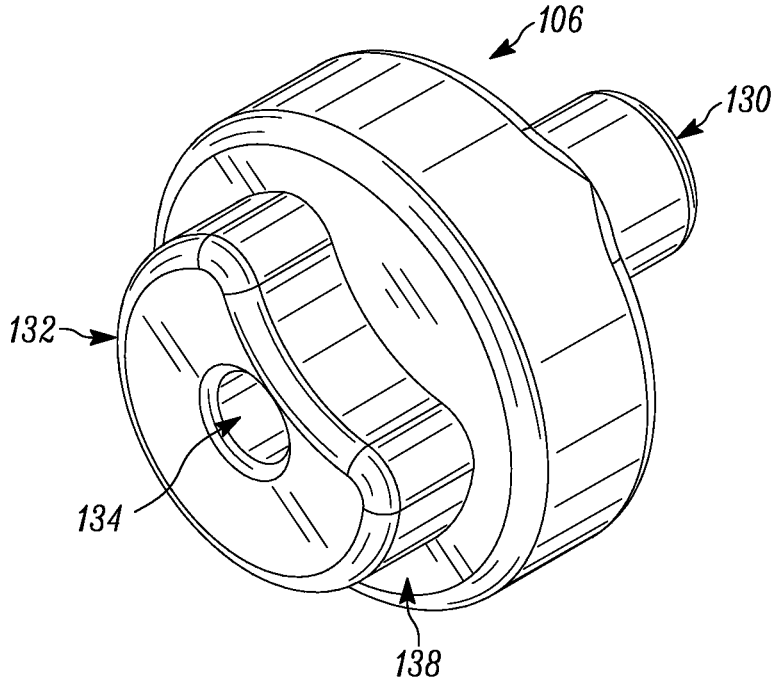
FIG. 8B of the drawings is a back perspective view of the cam of the present disclosure.

With reference to FIGS. 8A and 8B, the cam 106 includes a body having a first side 136 and a second side 138, and, an axis of rotation 134. The first side includes first follower 130 and the second side includes second follower 132. With reference to FIGS. 10A through 10E the cam is rotatably coupled to the motor 108 about an axle. It will be understood that the motor is positioned within a motor retaining region of a housing with the axle extending into a channel that is housing the slider and actuator. With continued reference to FIGS. 10A through 10E the cam 106 is positioned so that the body is within the longitudinal channel between the first and second cam profiles, the first follower 130 is configured to interface with the first cam profile 120 and the second follower 132 is configured to interface with the second cam profile 122. As can be seen in FIGS. 10A through 10E, sequentially, and as will be explained below in greater detail, as the motor rotates the cam 106 intermittently connects the first follower with the first cam profile, to, in turn, translate the slider within the slider channel. It will be understood that the actuator has been omitted from these figures for purposes of clarity.

It is contemplated that other cam profiles and other cam follower configurations may be utilized to achieve the intermittent interaction therebetween, to, translate the slider along the slider channel between a blocking position and a released position. It is further contemplated that the position of the two cam profiles can be swapped. Additionally, the slider may have an alternate configuration for the first cam profile or the second cam profile. For example, additional slots may be presented, and corresponding ridges to increase the stroke of the slider movement through additional rotation and interaction with the cam, if necessary.

Initially, with reference to FIGS. 1 and 2, concurrently, portions of the lock are shown in the unlocked configuration (FIG. 2 for configuration, with FIG. 1 for hidden components). In such a configuration, the slider is in the unlocked position, directed toward the handle member. The actuator 102, in the embodiment shown, is with the distal end 112 of the actuator 102 directed into the central bore 54 of the lock arm, pushing the first and second outward locking plugs 42, 44 into opposing locking plug grooves 39*a*, 39*b*, respectively. In such a position, the first and second outward locking plugs (the balls) each straddle between the radial bore and the locking plug grooves, with a portion in each thereof. In turn, if the user rotates the handle member about the lever grasping portion, and attempts to turn the handle member, the handle member and the lock assembly 22 will rotate in unison (through the coupling thereof by the outwardly directed first and second outward locking plugs 42, 44), as is shown in FIG. 7. The inward position of the actuator 102 precludes the balls from returning entirely into the radial bore of the lock arm body 45.

Figure 10A:
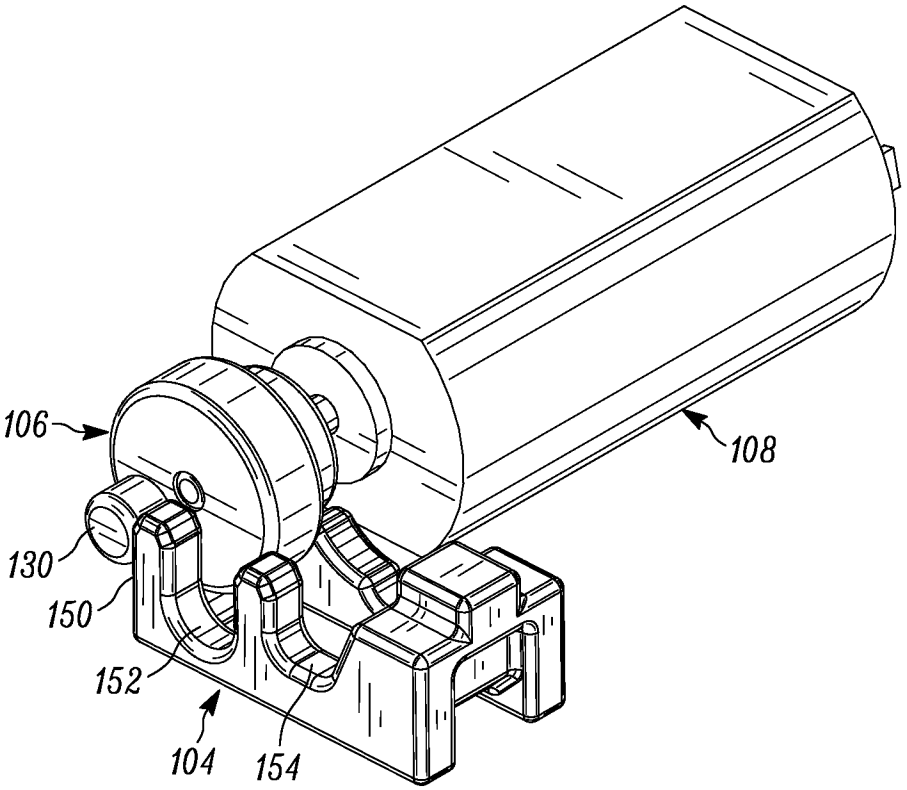
FIGS. 10A through 10E of the drawings are sequential perspective views of the slider, the cam and the motor as the cam and slider move from the unlocked position to the locked position.

Additionally, in the unlocked configuration, the cam 106 is rotated such that the first follower 130 engages the first cam profile at the first slot 150. At the same time, the second follower engages the first ramp 156. Such a configuration is also shown at FIG. 10A with respect to the motor, cam and slider. As will be explained below, the sequence of moving the slider from an unlocked position to a locked position is achieved through rotation of the cam through approximately one and one half revolutions (although variations are contemplated which require lesser or greater revolutions of the cam and the motor).

To lock the lock so that rotation of the handle member does not impart rotation on the lock assembly and the lock arm thereof, the user must direct the motor to rotate in the appropriate direction. It will be understood that the control of the motor is generally achieved through an electronic control assembly (not shown).

Figure 10B:
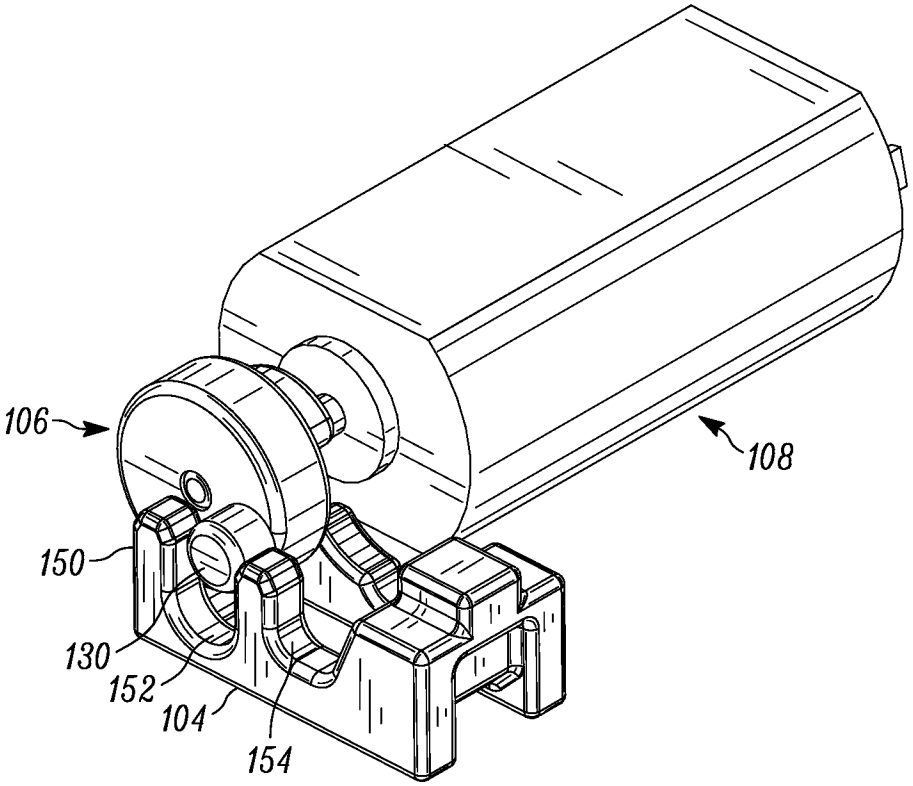
Figure 10C:
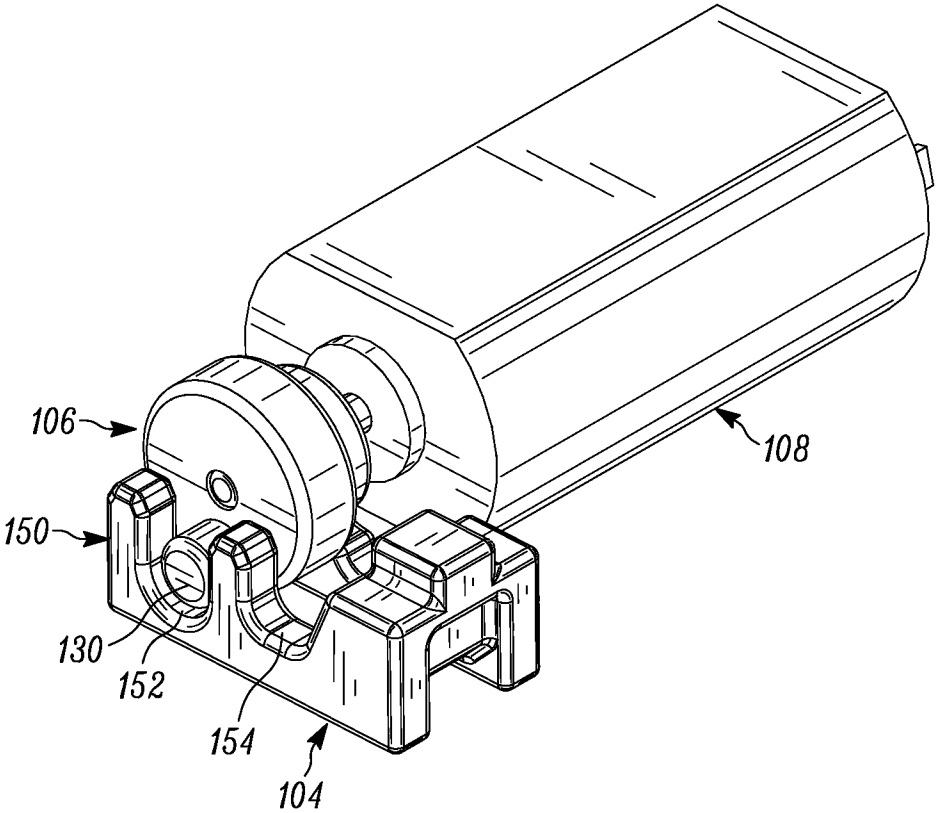
Figure 10D:
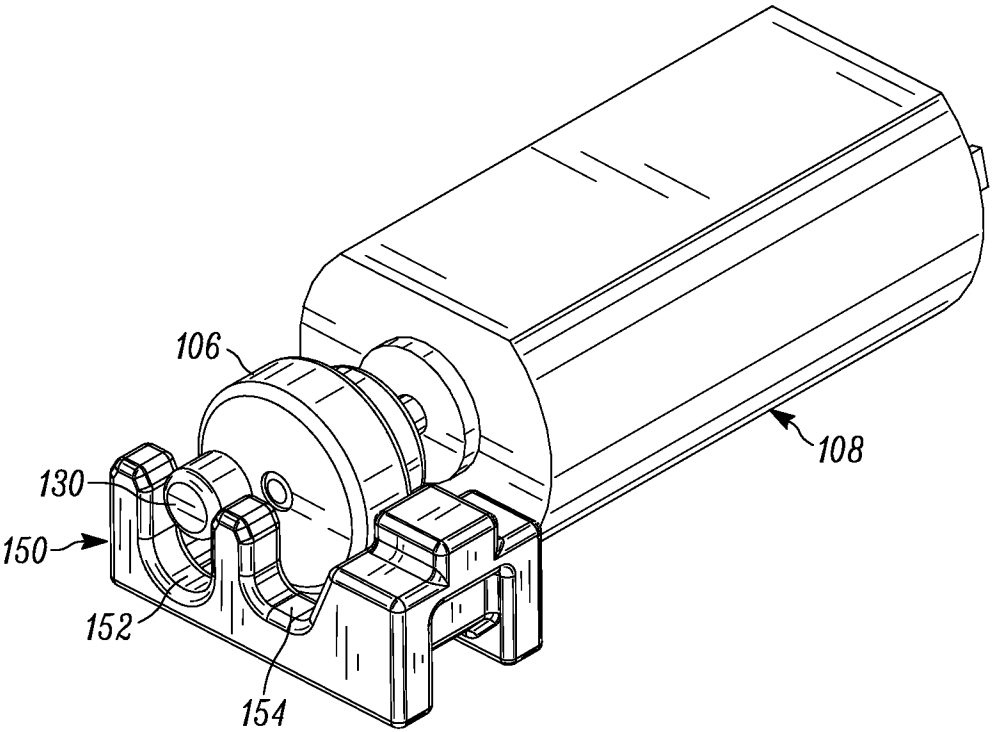

When the motor is actuated in a first direction, the cam 106 rotates in a first direction disengaging the first follower 130 from the first slot 150 (FIGS. 10A through 10E) the motor continues to rotate, and the first follower 130 eventually enters into the second slot 152 (FIG. 10B). Eventually, the continued rotation of the cam 106 with the first follower 130 positioned in the second slot 152 begins to translate the slider 104 (FIGS. 10C and 10D). It will be understood that, advantageously, the cam 106 rotates through an arcuate distance prior to engaging the first cam profile with force being directed upon the slider in a translating direction. In the embodiment shown, the cam 106 rotates through about a half turn prior to initiating the translation of the slider. Advantageously, the motor is allowed to initiate rotation without load, such that momentum can be built up, which momentum is sufficient to initiate translation of the slider. Such a momentum building, relatively load free, initiating step removes the need to utilize a gear train to reduce the speed of the cam or to increase the torque applied by the cam. Rather, a direct drive of the cam by the motor (which greatly simplifies the construction) can be utilized.

Figure 10E:
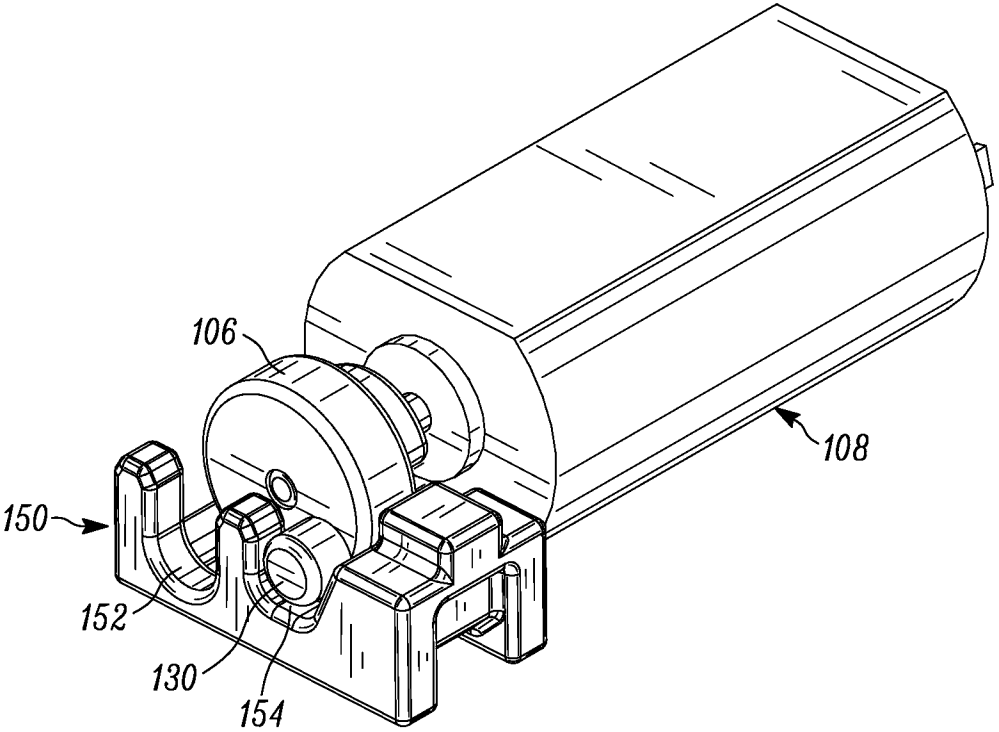

As the rotation of the cam 106 continues, eventually, the slider continues to translate due to the interaction of the first follower 130 within the second slot 152 of the first cam profile. Eventually, the first follower 130 reaches a point, as does the slider 104 wherein the first follower 130 no longer exerts a force on the slider 104 to translate further (FIG. 10D). Shortly thereafter, the first follower 130 exits from the second slot 152 and continued rotation directs the first follower 130 into the second slot. When the first follower 130 is fully inserted into the second slot, further movement is precluded (FIG. 10E). The controller senses that the first follower is in such a position (i.e., through a sensing of the draw of the motor, or through other means, such as a sensor or the like), and directs the motor to cease rotation. In another embodiment, a timer can trigger the motor circuit to de-energize the motor.

The slider is now in the locked orientation shown in FIGS. 3 and 10E. That is, the slider has moved away from the central bore 54 a sufficient distance so as to remove the actuator 102 from within the central bore 54 of the body 45. The engagement of the cam 106 with the third slot 154 and the interaction of the second follower 132 with the second cam profile, maintains the slider in the locked configuration. With the actuator 102 removed from within the central bore, the first and second outward locking plugs (i.e., the balls) are free to return into the radial bore. Such movement can be achieved through the rotation of the lock arm body 45 relative to the handle member. Such rotation directs the balls back into the radial bore and allows the continued rotation of the lock arm body 45 relative to the handle member 20.

To again unlock the lock, the user turns the lever back to the initial configuration, lining up the locking plug grooves 39*a*, 39*b* of the cylinder portion of the handle member with the radial bore 56 of the lock arm body 45.

Next, the motor is activated again, by the electronic controller, in the opposite direction from the direction of rotation during unlocking. The steps shown in FIGS. 10A through 10E are carried out in reverse. Namely, the cam 106 is rotated by the motor, and the first follower 130 exits the third slot, extends over the second ridge 153 and enters the second slot 152 (FIGS. 10E and 10D). Continued rotation imparts a force upon the slider having a component in the direction of the locked position and the slider slidably moves toward the locked position. Eventually, the slider reaches a position wherein the cam 106 no longer slidably moves the slider (FIG. 10B). In such a position, further rotation of the cam 106 directs the first follower 130 to exit the second slot, traverse over the first ridge 153 and returns to first slot 150 (FIG. 10A).

Similar to that which was explained above with respect to the unlocking procedure, during the locking procedure, the cam 106 rotates an arcuate distance without the first follower 130 imparting a force on the first cam profile of the slider. As such, the cam can gather speed, and in turn, momentum, such that when the cam enters the second slot 152, the cam has sufficient force to impart onto the slider to translate the slider. Such an intermittent contact with the first cam profile, and intermittent application of a translational force allows for the use of a directly driven cam, and a motor smaller than would otherwise be required. Furthermore, the consumption of power from the battery is reduced for each cycle as compared to a rack and pinion with constant engagement and application of force therebetween.

Once in the first slot 150, the cam 106 is precluded from rotation as the slider has reached the end position. Thus, while rotation is precluded, the motor continues to impart a rotational force on the cam 106, thereby increasing the power draw. The electronic controller realizes the increased power draw by the motor as a signal that the slider has returned to the locked position. In turn, the power to the motor ceases.

In this position, as is shown in FIG. 2, the slider 104 is in a position that the slider 104 has directed the actuator 102 into the central bore 54 of the body, again, pushing the first and second outward locking plugs to be within each of the radial bore and the locking plug grooves 39*a*, 39*b*. As such, the lock arm body 45 is again locked with the handle member so as to move in unison. The user can then rotate the handle member, and the latch leg can selectively engage or disengage a stationary member to release and to allow for the opening of the door or drawer.

In a second configuration of the disclosure, shown in FIGS. 11 through 19, the configuration differs with respect to the actuator 102 and the slider 104. In particular, the actuator is a separate component from the slider and the two are slidably movable (within a range) relative to each other, and the actuator is biased relative to the slider, through spring 105.

More particularly, in such a configuration, the slider 104 includes slider cavity 60 at the actuator engagement body. Generally the cavity has an open top, and a slot 62 in an end wall thereof to provide access to the slider cavity 60. The actuator 102 further includes flange 64, stopper 66 and slidable axle 68. The flange 64 is positioned between the proximal end 110 and distal end 112 and spaced apart from each of the ends. The stopper 66 is positioned at the proximal end 110. Both the flange and the stopper are sized so as to be precluded from passage through the slot 62 of the slider. The slidable axle 68 spans between the flange 64 and the stopper 66 and is configured to slidably translate along and through the slot 62. The slidable movement is limited by the stopper engagement with the slider on a wall opposite the wall containing the slot 62 at the first end of travel, and by the wall having the slot 62 at the other end of travel. The biasing spring 105 extends between the slider proximate the slot 62 and the flange 64 of the actuator 102. Thus, the stopper 66 is biased by the spring 105 toward the wall having the slot 62, thereby biasing the distal end of the actuator away from the slider.

The operation of the configuration is substantially the same as the first configuration. However, in the first configuration the locking plug grooves 39*a*, 39*b* of the handle member must be lined up with the radial bore 56 of the lock arm body before the motor can be actuated to direct the slider, and in turn the actuator into the central bore 54 of the lock arm body. When not lined up, the balls cannot be moved out of the radial bore 56 into the locking plug grooves 39*a*, 39*b*, thereby precluding further inward movement of the actuator. As the actuator and the slider are coupled, precluding the actuator, in turn, precludes movement of the slider.

With the second embodiment, the slider and actuator have the ability to move (in certain configurations) relative to each other. In particular, to unlock the lock, the actuator is directed into the central bore 54 of the lock arm body 45. In the second configuration, if the handle member is rotated relative to the lock arm body 45 of the lock assembly 22, such that the locking plug grooves 39*a*, 39*b* are not lined up properly with the radial bore 56, the distal end of the actuator will contact the balls 42, 44 and further movement of the actuator will be precluded. However, the slider 104 can continue to move toward the lock assembly. This relative movement of the actuator and the slider will cause the slider to overcome the spring 105 and to compress the same. The stopper will be directed away from the wall having the slot 62 toward the opposing wall.

When the handle member is rotated so that the locking plug grooves 39*a*, 39*b* line up and correspond to the radial bore 56, the biasing member will exert a force on the actuator so that the distal end pushes the balls 42, 44 outwardly and into the locking plug grooves 39*a*, 39*b*. This locks the handle member to the lock arm body and unlocks the lock by permitting the handle member to turn the lock arm body and the latch leg. In this manner, the construction of the spring, actuator 102 and slider 104 provide a clutch which allows for the motor to execute a lock or unlock cycle regardless of the orientation of the handle member and the lock arm body.

With reference to FIGS. 20 through 29, another configuration of the actuator 102 and the slider 104 is shown. The actuator and slider are modified so as to rotate in place of translating. In such a configuration, the slider 104 is replaced with second rotating cam 204 having a rotation actuator 202 coupled thereto. In such a configuration, the rotation of the cam 106 engages the second cam 312 to selectively rotate. The actuator includes recessed portions 210 and protruding portion 212. The recessed portions are spaced apart from each other by 180° with the protruding portions 212 extending therebetween. The recessed portions 210 are substantially semi-cylindrically shaped, or otherwise outwardly concave such that the balls can be urged by the surface into the locking plug grooves 39*a*, 39*b*. Such a configuration can be seen in FIG. 20, and the components in FIGS. 28 and 29.

Figure 24:
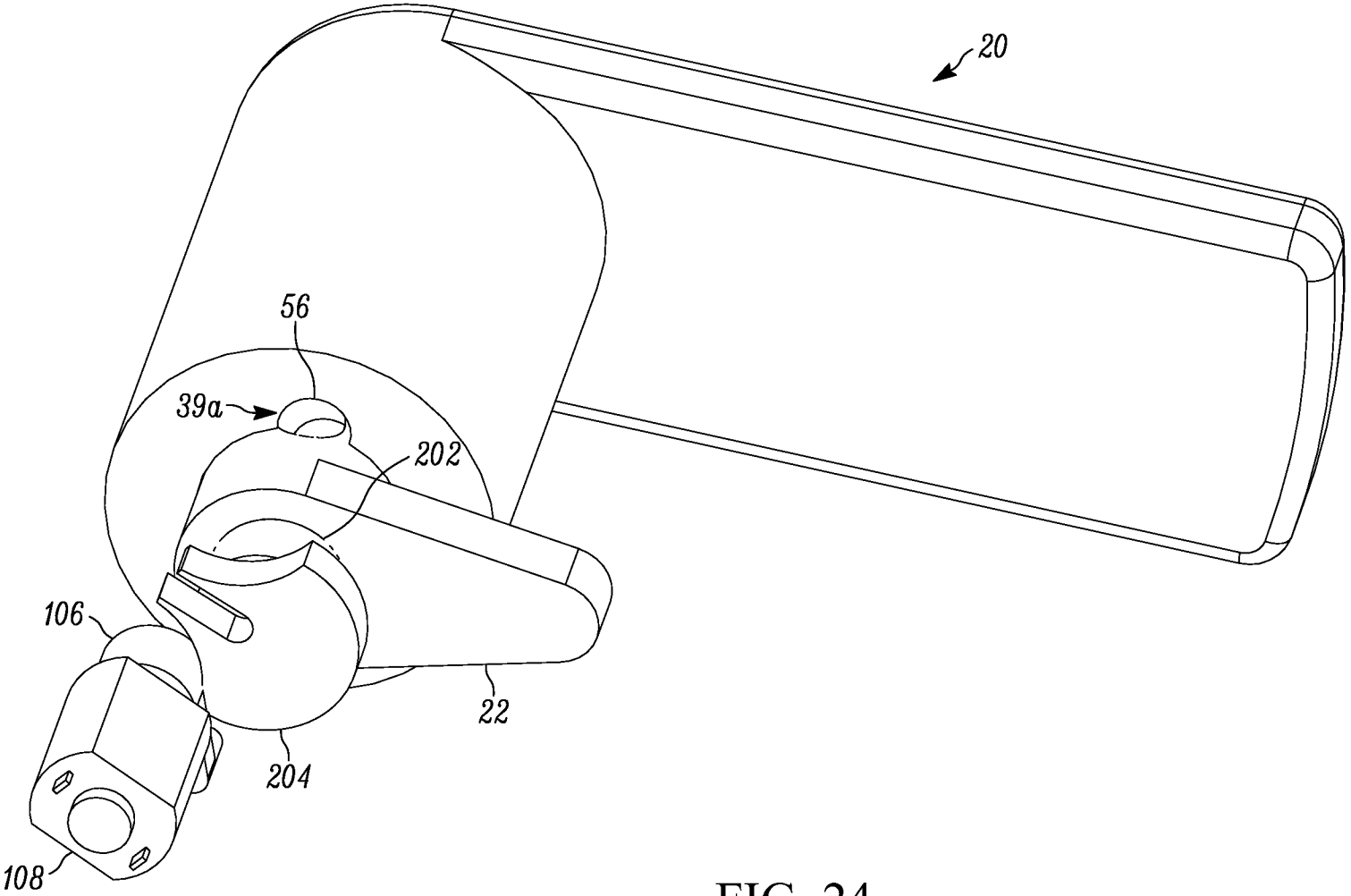
FIG. 24 of the drawings is a perspective view of a third configuration of the lock of the present disclosure, showing, in particular, the interaction of the lock assembly with the lock actuating assembly, wherein the lock is in a locked configuration.
Figure 25:
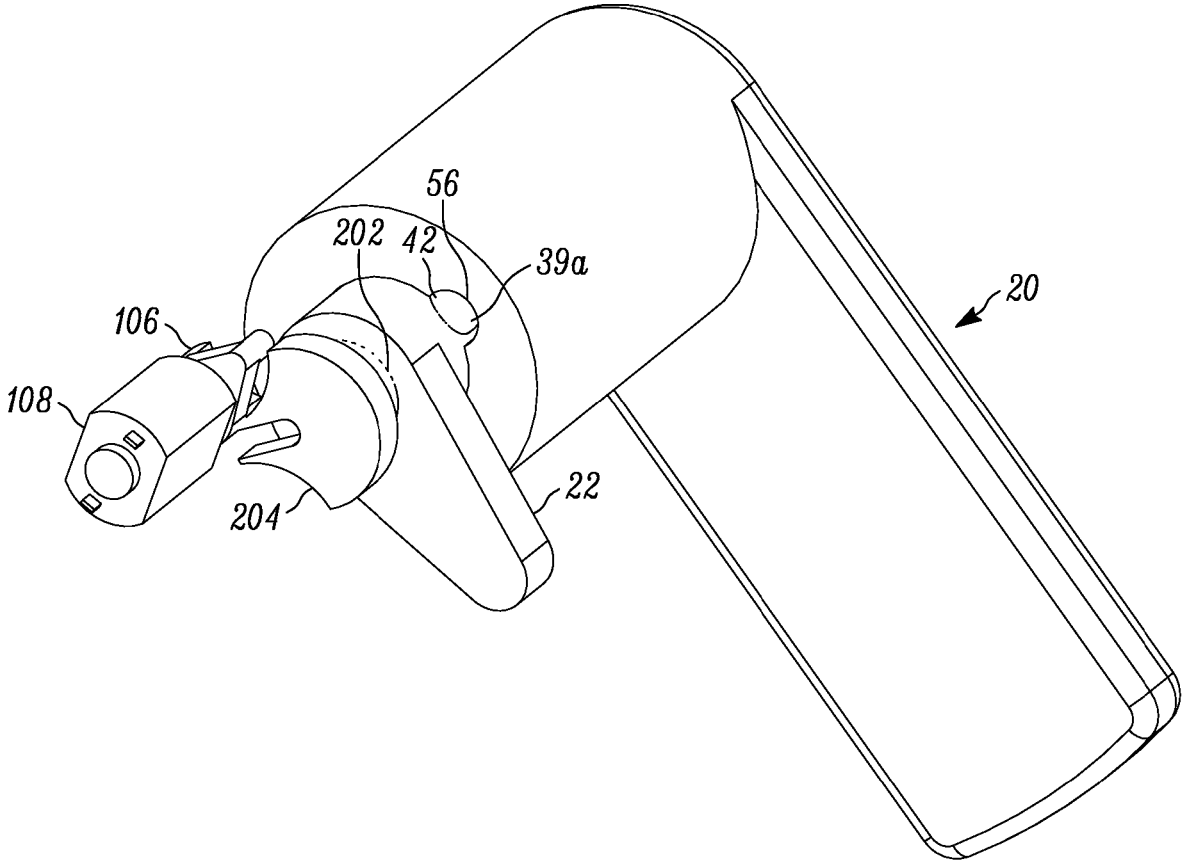
FIG. 25 of the drawings is a perspective view of a third configuration of the lock of the present disclosure, showing, in particular, the interaction of the lock assembly with the lock actuating assembly in an unlocked configuration, with the handle member and the lock assembly together being rotated in unison through the joining thereof by the first and second outward locking plugs (the balls)
Figure 26:
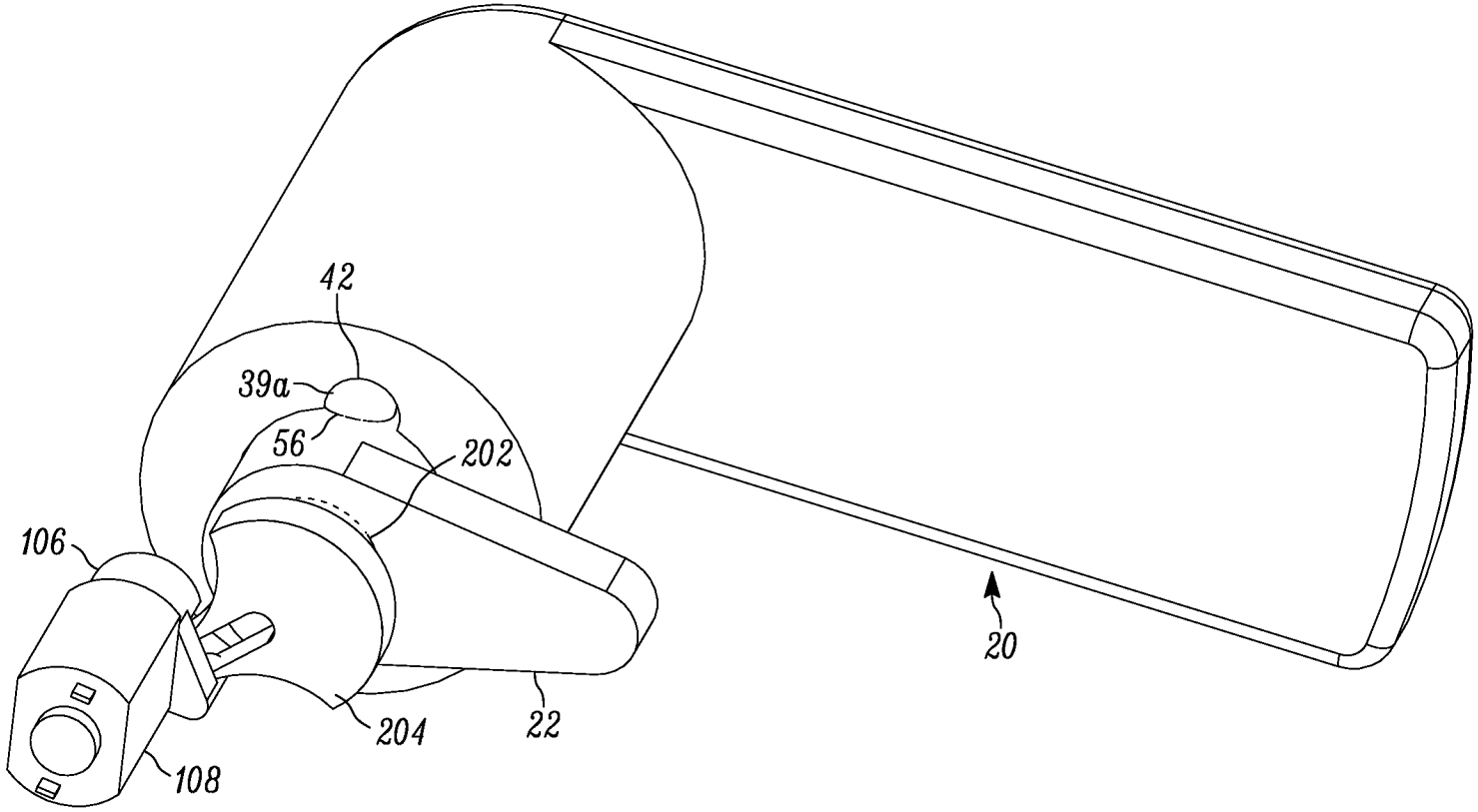
FIG. 26 of the drawings is a perspective view of a third configuration of the lock of the present disclosure, showing, in particular, the interaction of the lock assembly with the lock actuating assembly in an unlocked configuration.
Figure 27:
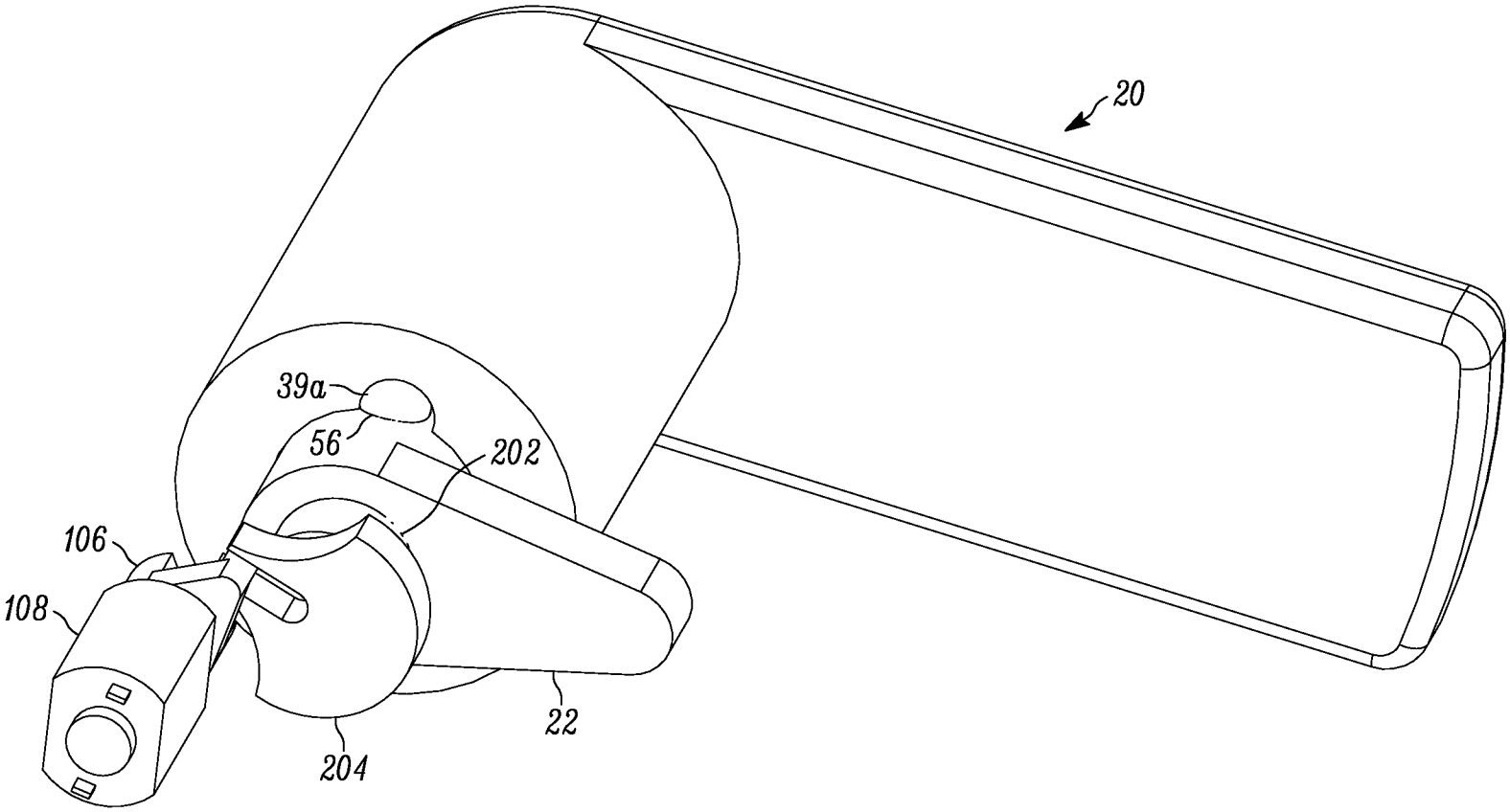
FIG. 27 of the drawings is a perspective view of a third configuration of the lock of the present disclosure, showing, in particular, the interaction of the lock assembly with the lock actuating assembly in a locked configuration.
Figure 28:
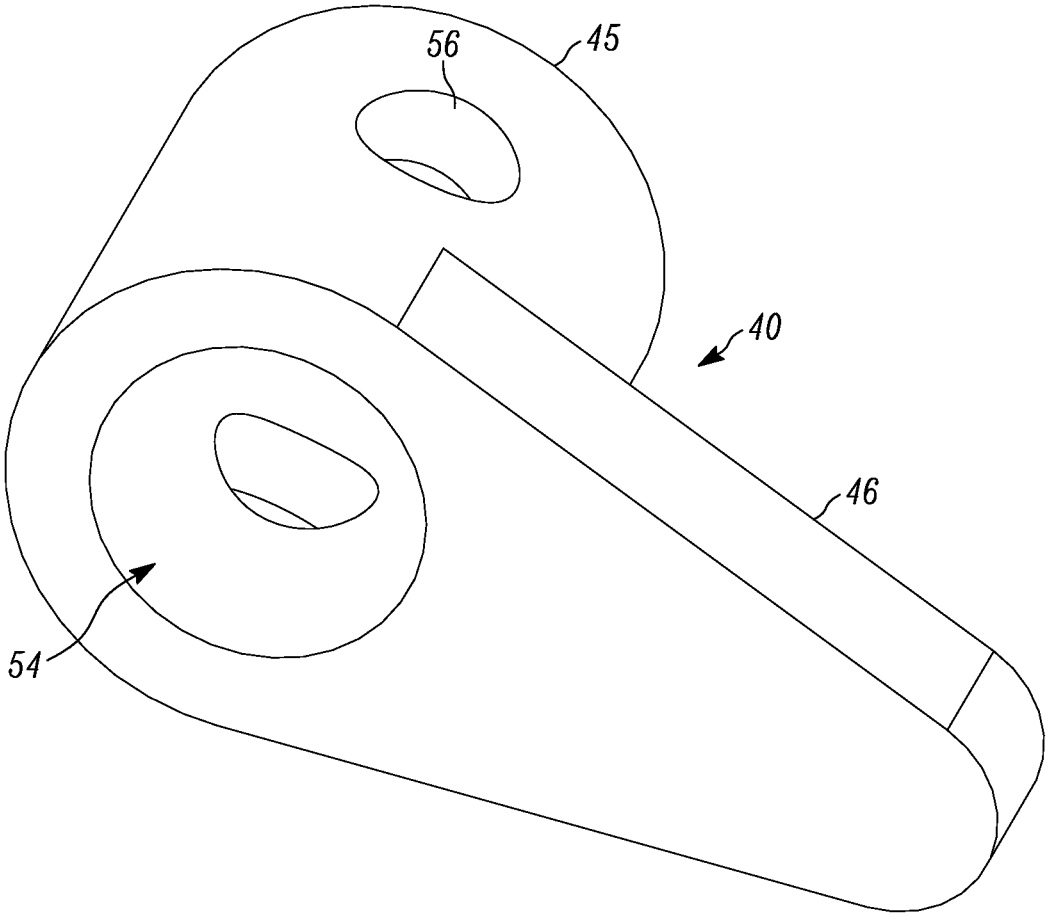
FIG. 28 of the drawings is a perspective view of the lock arm of a third configuration of the present disclosure.
Figure 29:
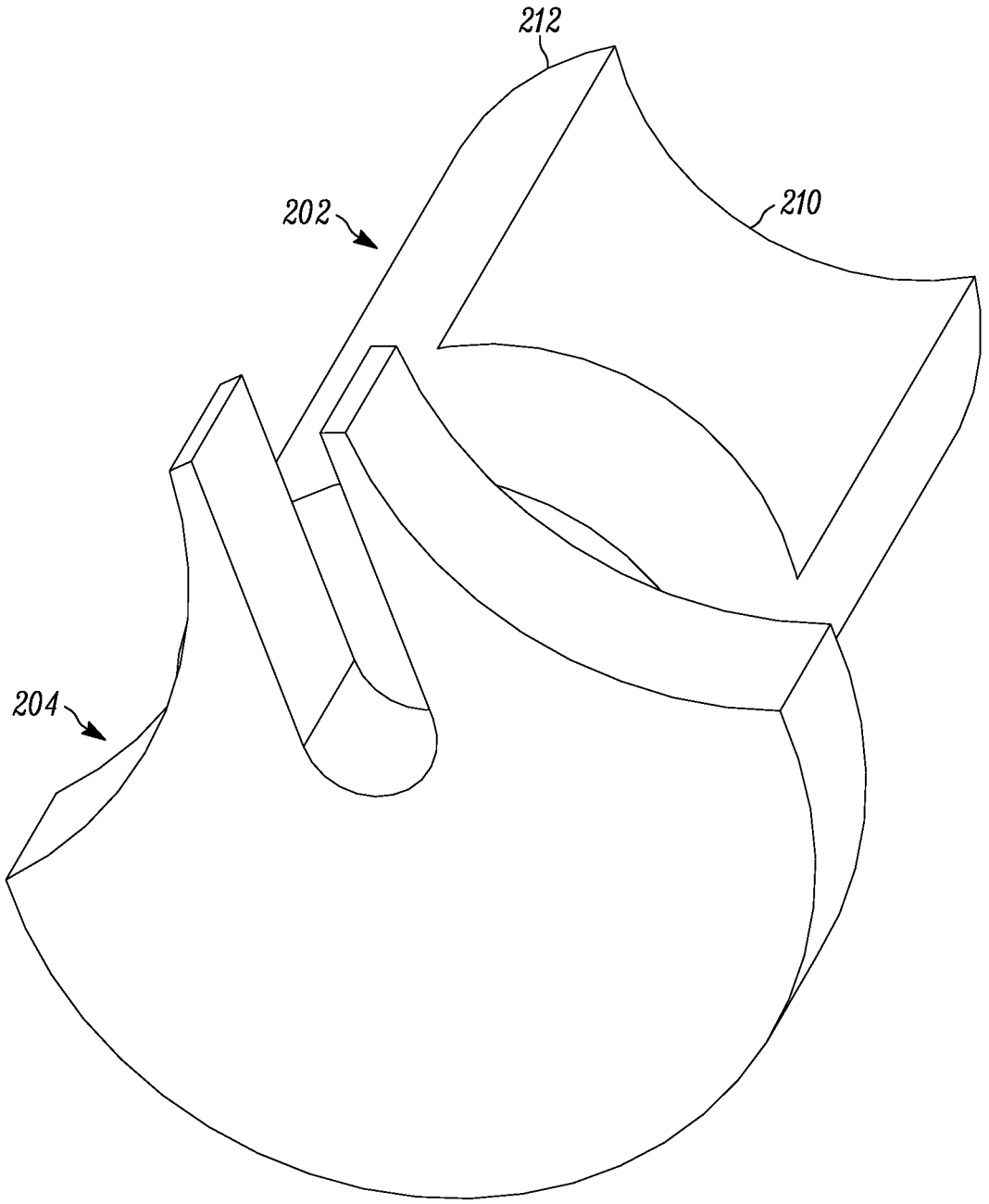
FIG. 29 of the drawings is a perspective view of the actuator and second cam of a third configuration of the present disclosure.
Figure 30:
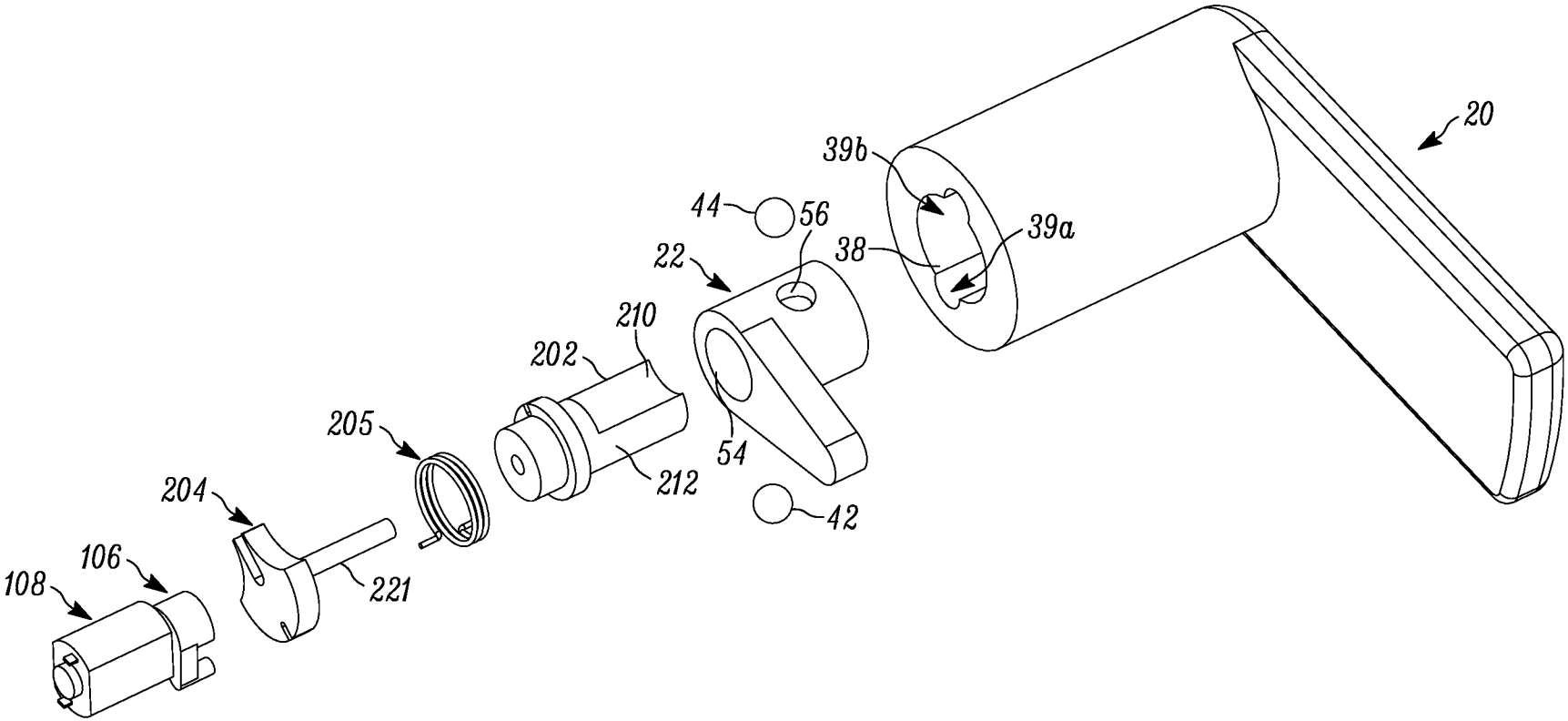
FIG. 30 of the drawings is an exploded perspective view of a fourth configuration of the lock of the present disclosure.
Figure 31:
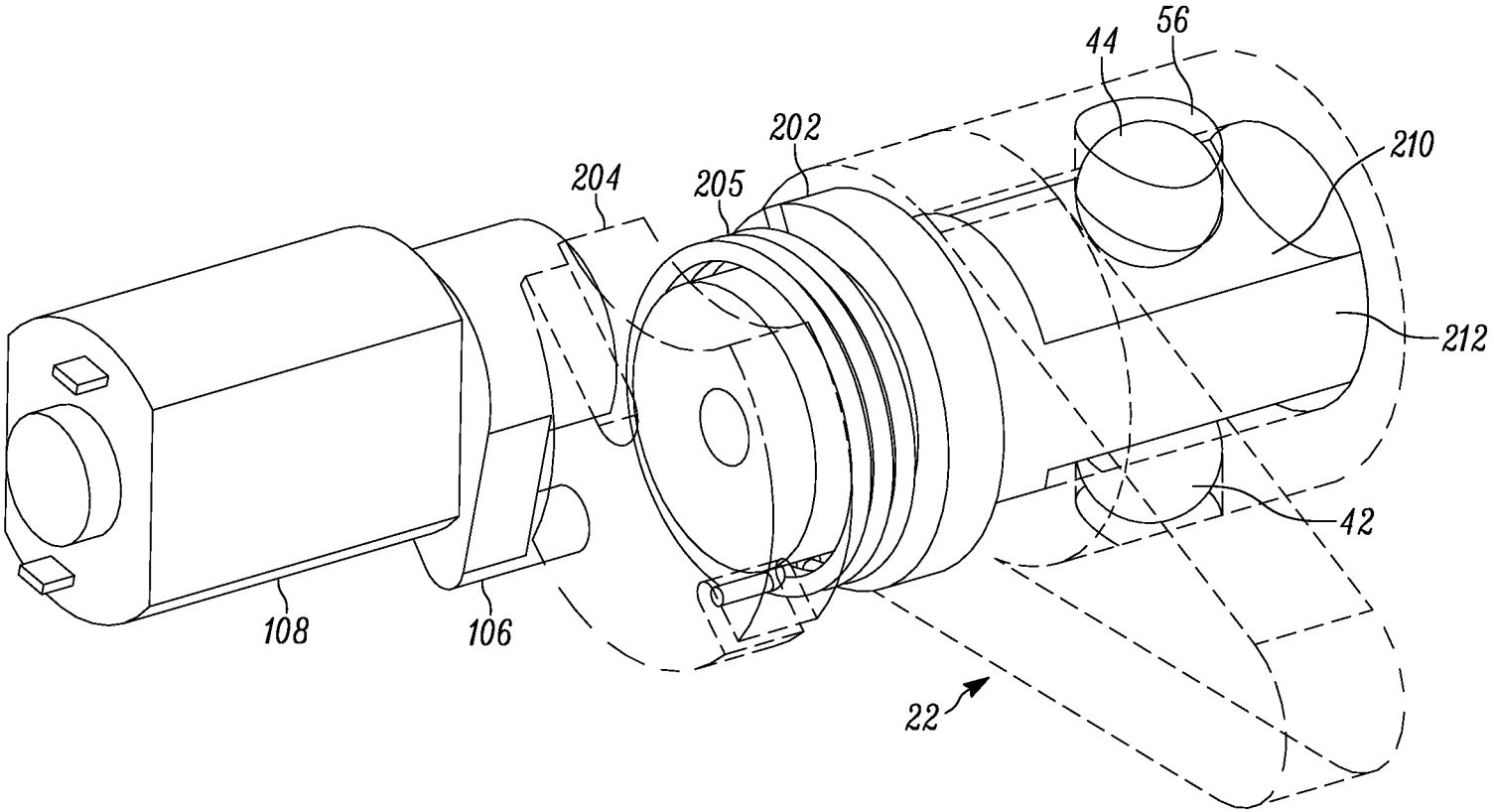
FIG. 31 of the drawings is a partial perspective view of a fourth configuration of the lock of the present disclosure, showing, in particular, a locked configuration.
Figure 32:
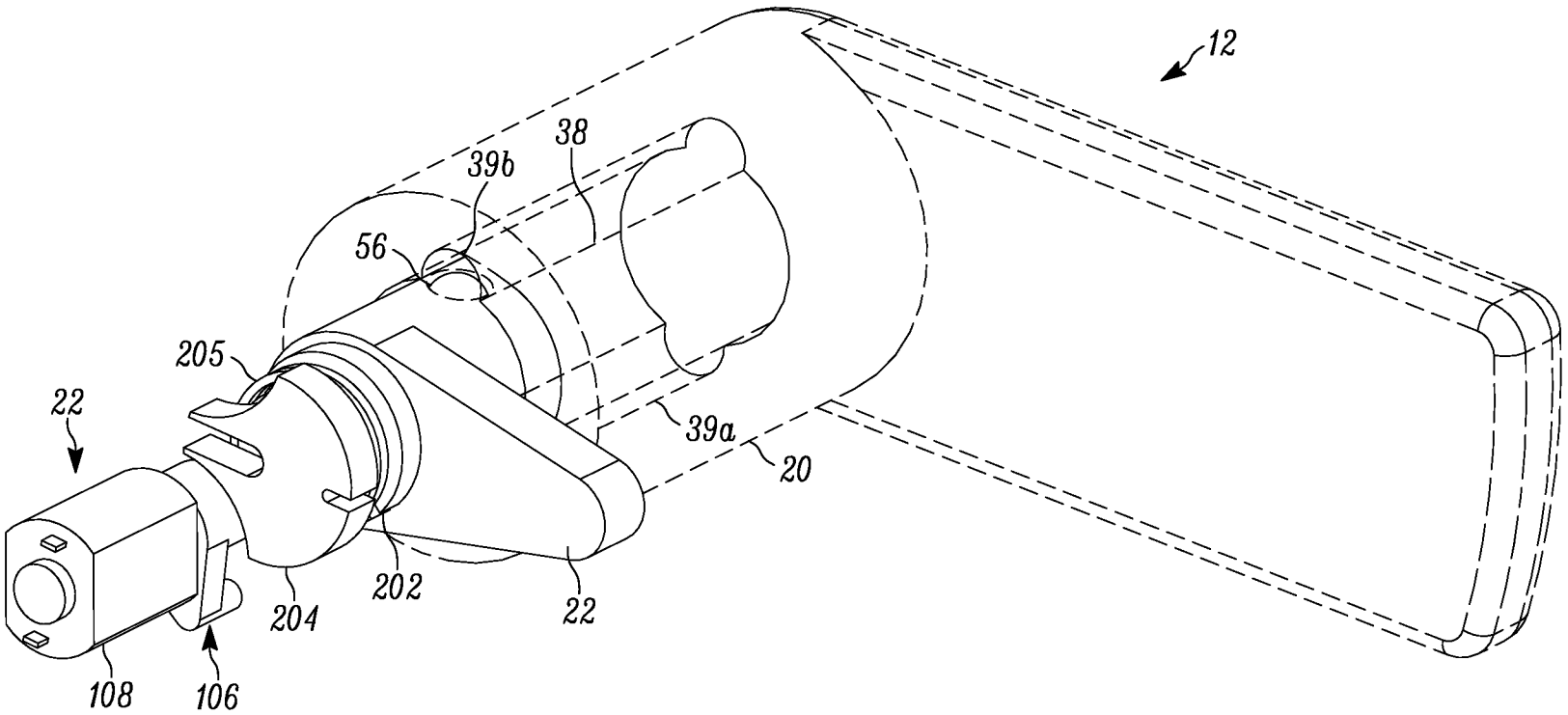
FIG. 32 of the drawings is a perspective view of a fourth configuration of the lock of the present disclosure, showing, in particular, a locked configuration.
Figure 33:
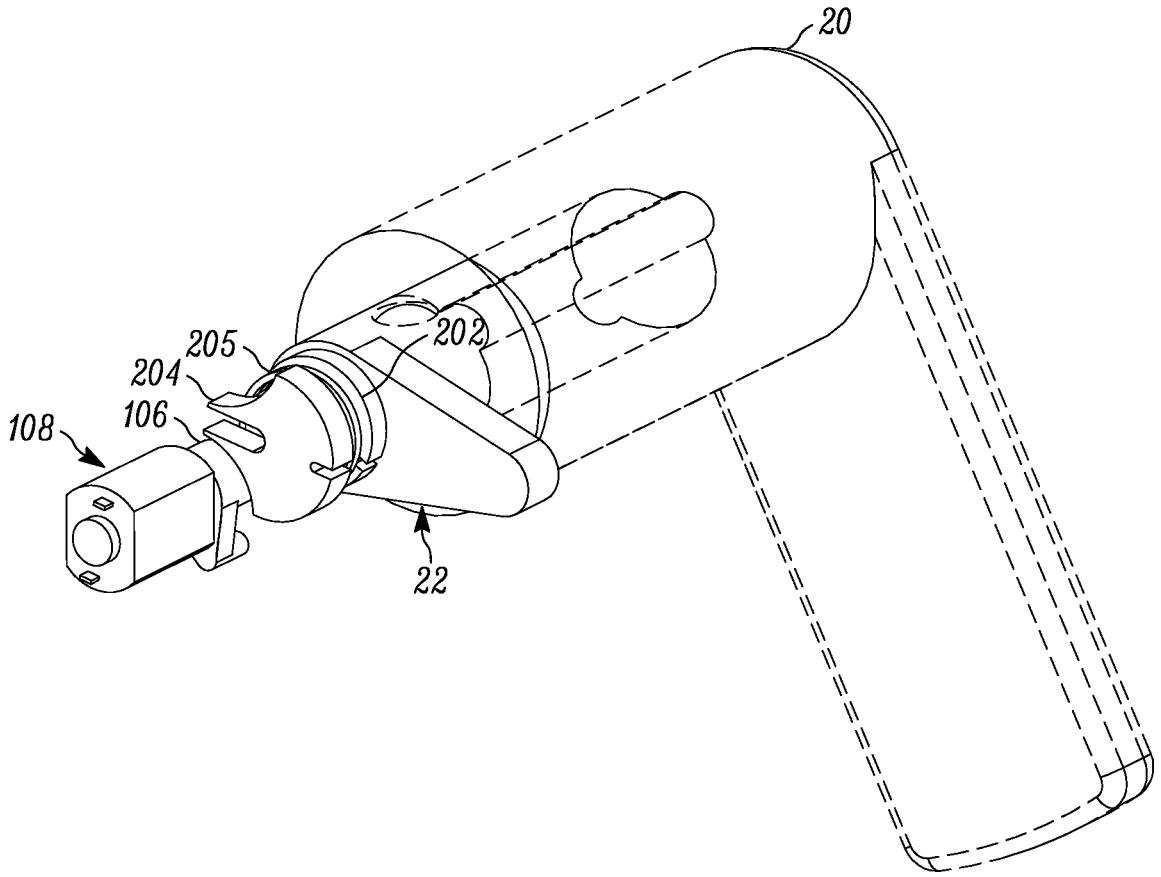
FIG. 33 of the drawings is a perspective view of a fourth configuration of the lock of the present disclosure, showing, in particular, the interaction of the lock assembly with the lock actuating assembly in a locked configuration, with the handle member being rotated so that the locking plug grooves are not aligned with the radial bore.
Figure 34:
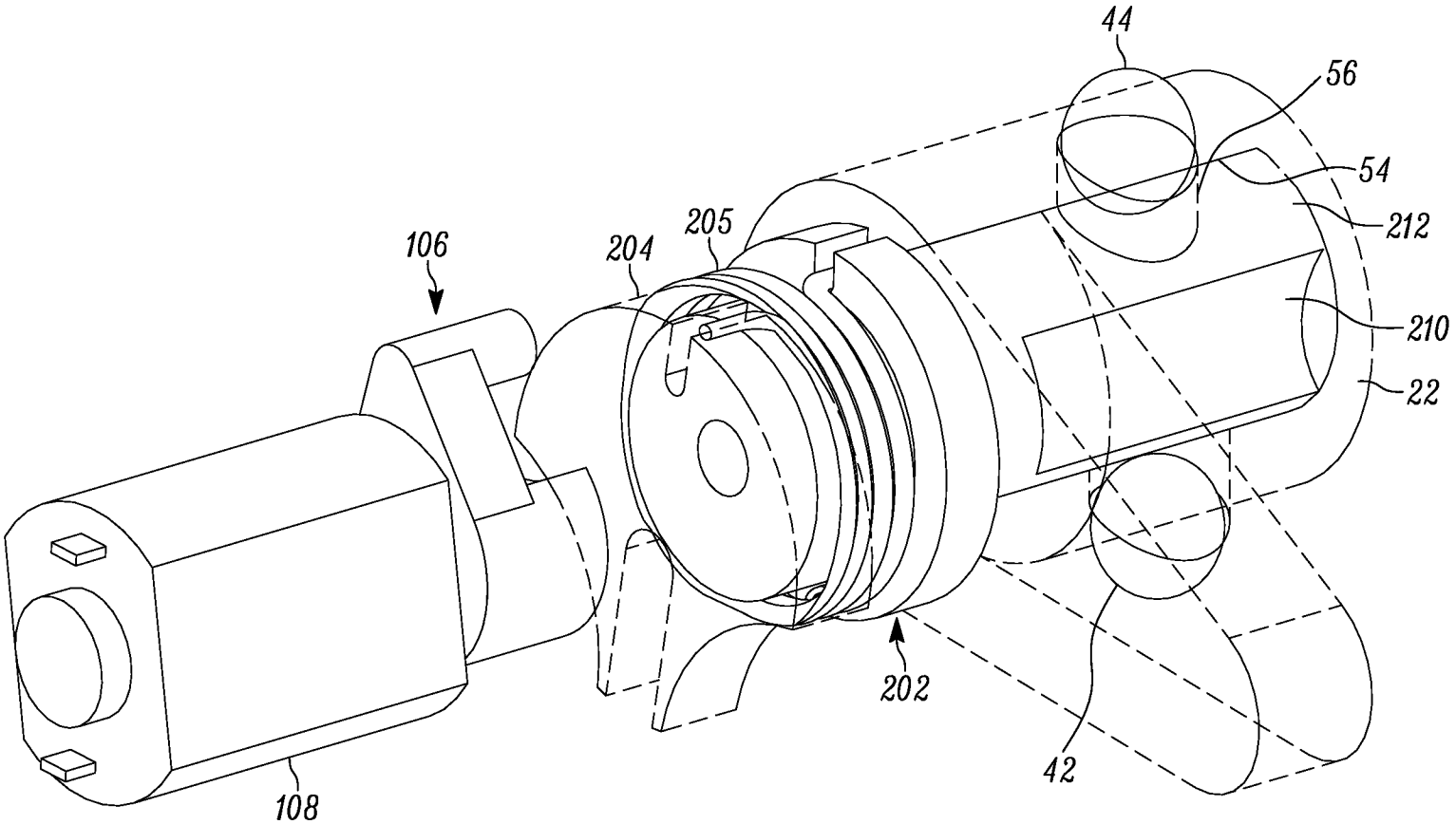
FIG. 34 of the drawings is a partial perspective view of a fourth configuration of the lock of the present disclosure, showing, in particular, the interaction of the lock assembly with the lock actuating assembly in the unlocked configuration.
Figure 35:
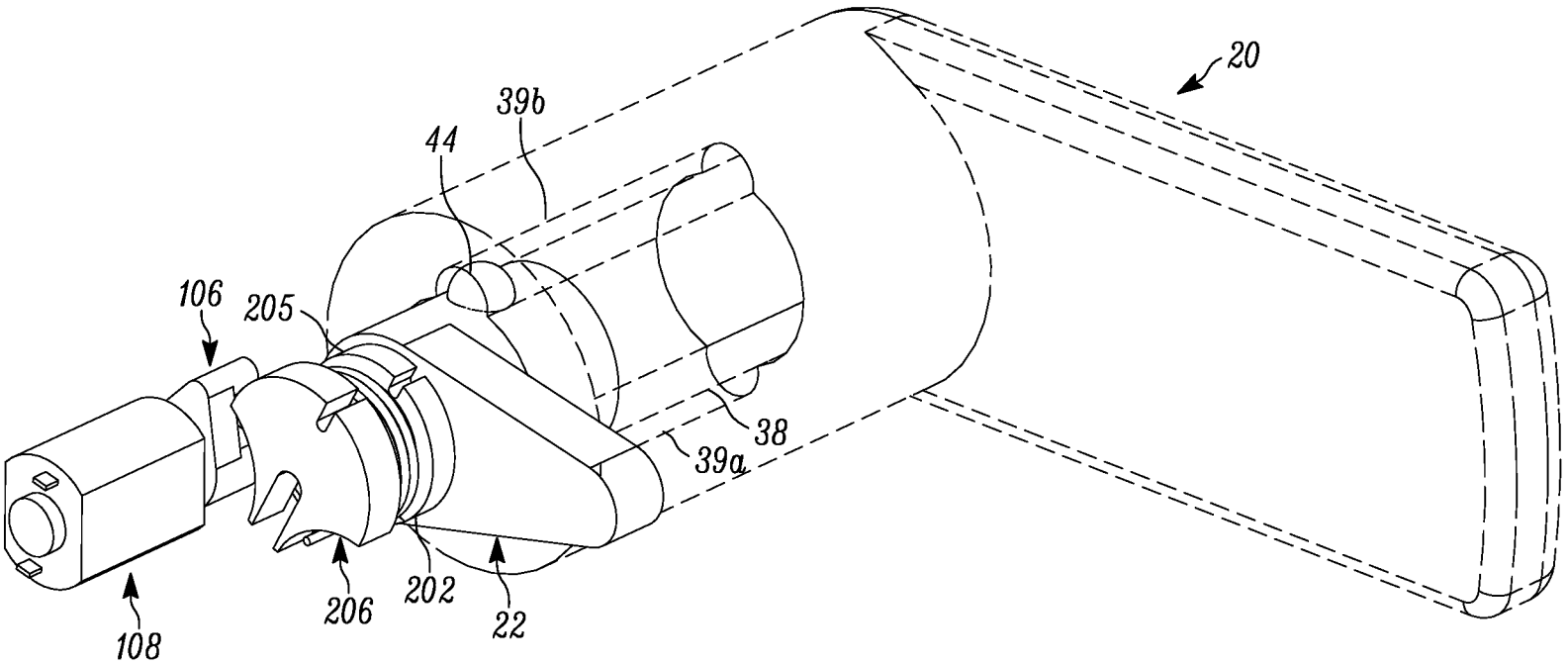
FIG. 35 of the drawings is a perspective view of a fourth configuration of the lock of the present disclosure, showing, in particular, the interaction of the lock assembly with the lock actuating assembly in an unlocked configuration.
Figure 36:
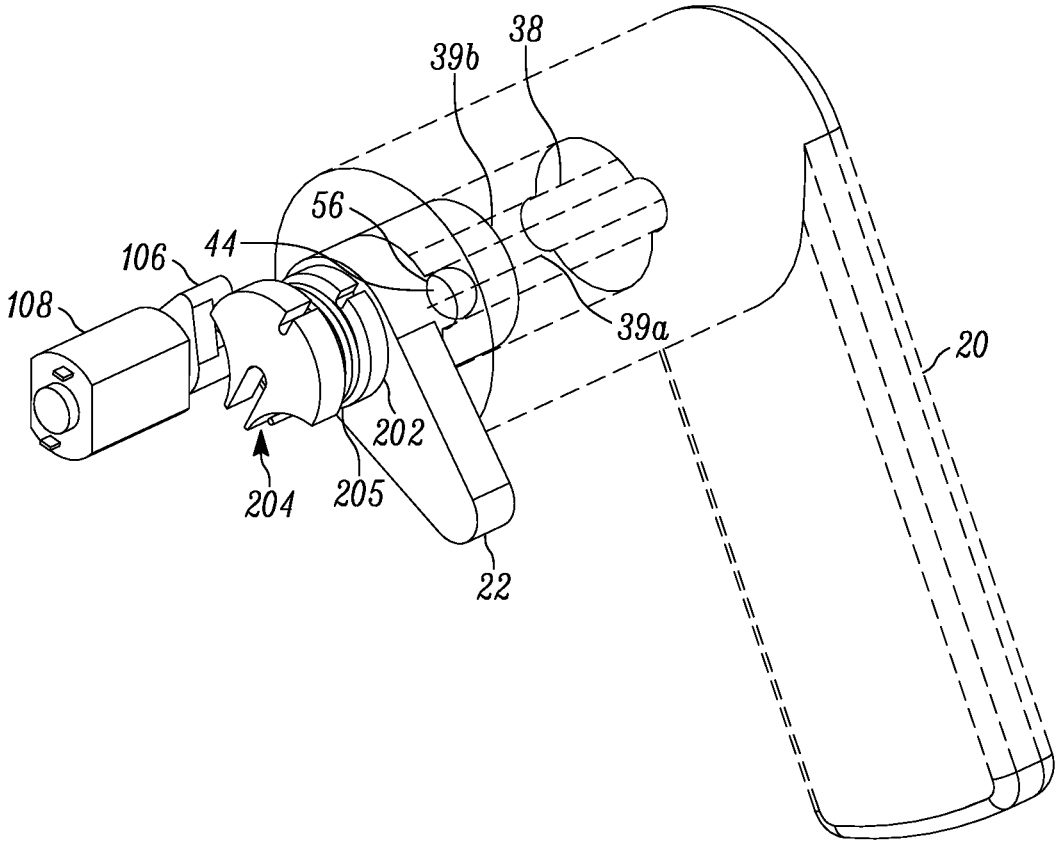
FIG. 36 of the drawings is a perspective view of a fourth configuration of the lock of the present disclosure, showing, in particular, the interaction of the lock assembly with the lock actuating assembly in an unlocked configuration, with the handle member and the lock assembly together being rotated in unison through the joining thereof by the first and second outward locking plugs (the balls)
Figure 37:
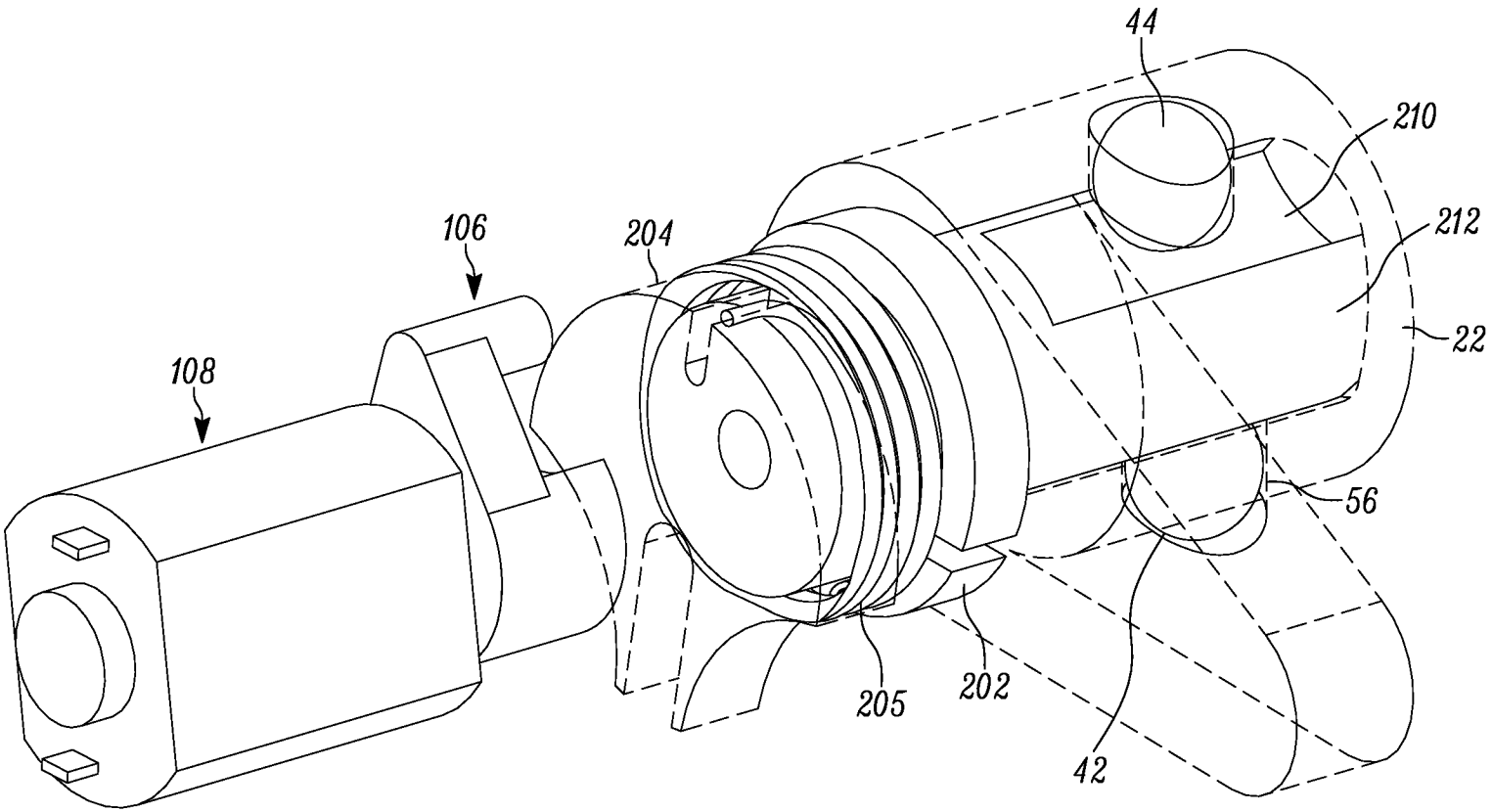
FIG. 37 of the drawings is a partial perspective view of a fourth configuration of the lock of the present disclosure, showing, in particular, the interaction of the lock assembly with the lock actuating assembly in a locked configuration.
Figure 38:
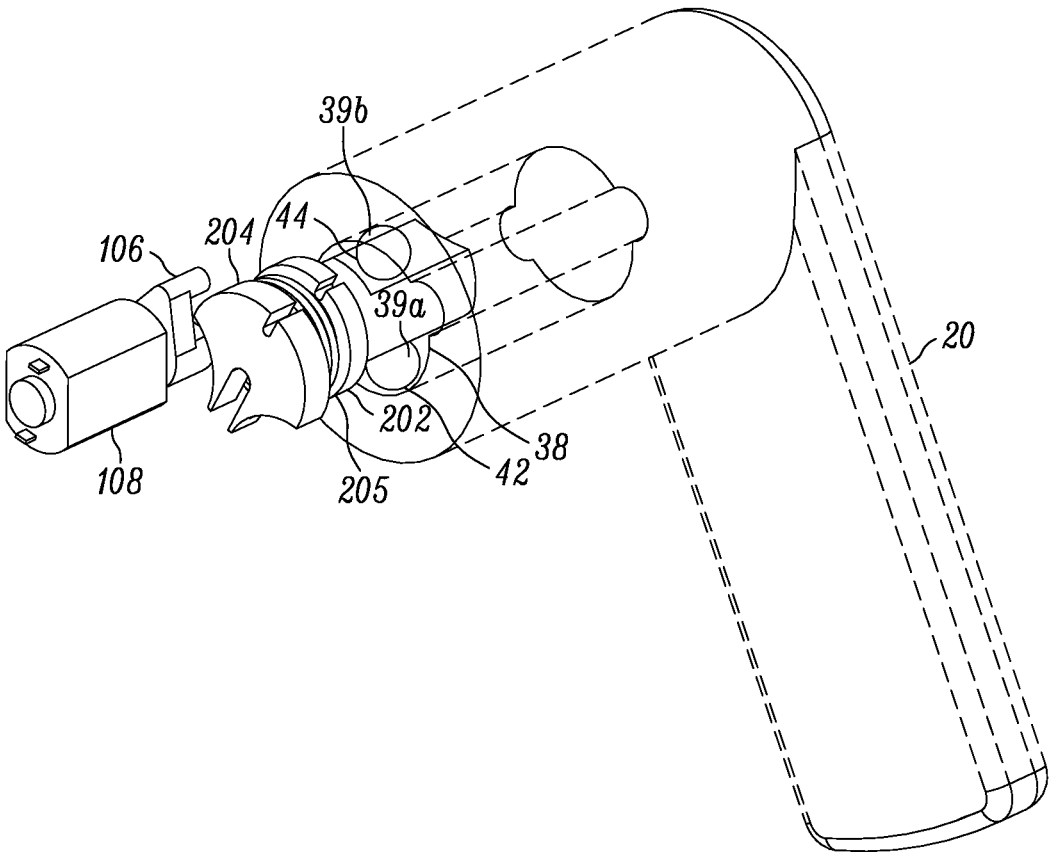
FIG. 38 of the drawings is a perspective view of a fourth configuration of the lock of the present disclosure, showing, in particular, the interaction of the lock assembly with the lock actuating assembly in a locked configuration, with the handle member being rotated relative to the lock assembly.

In the locked configuration, shown in FIGS. 24 and 27, the recessed portions 210 are maintained in correspondence with the locking plug grooves 39*a*, 39*b*. In such a configuration, the balls can be directed into the recessed portions, and the lock arm body 45 of the lock assembly 22 is free to rotate relative to the handle member 20. Thus, rotation of the handle will not impart movement on the lock arm, and in turn, the latch leg 46 will remain stationary.

To unlock the lock, the motor is actuated. The motor rotates the first cam, which imparts contact with the second cam to rotate the second cam. The cam is rotated through 90° of rotations so that the protruding portions 212 correspond to the locking plug grooves 39*a*, 39*b*. As the second cam is rotated, the balls are urged outward by the concave surface of the recessed portions into the radial bore 56 and the locking plug grooves 39*a*, 39*b*, thereby locking the lock arm body with the handle assembly. As such, the two will turn in unison and the lock is in the unlocked configuration. Such a configuration is shown in FIGS. 22, 23, 25 and 26.

Returning the lock to the locked configuration is accomplished through a procedure that is opposite of that which has been described. In particular, the motor is rotated in the opposite direction, which rotates the cam. The cam then selectively interfaces with the second cam and rotates the same. The rotation continues, rotating the actuator so that the recessed portions 210 correspond to the locking plug grooves 39*a*, 39*b*, and with the radial bore 56. The balls are therefore movable from within the locking plug grooves 39*a*, 39*b* and into the recessed portions 210 (and the radial bore 56 of the lock arm body 45). As such, rotation of the handle member does not impart rotation to the lock arm body, and, in turn, the lock arm body remains in the locked configuration.

The fourth configuration is shown in FIGS. 30 through 38. The fourth configuration has an operation substantially the same as that of the third configuration, however, the second cam 204 is a separate component from the actuator 102, and the two are coupled together by way of a spring 205. In the configuration shown, the second cam 204 has an axis 221 which is inserted into a bore of the actuator 102. As such, the two components have the same axis of rotation. The spring is positioned between the two components so that a rotation of cam imparts a force onto the spring, which, in turn, imparts rotation of the actuator. If the actuator is precluded from rotation, the biasing spring allows the second cam to continue rotating and will store energy that can be released onto the actuator when the actuator is capable of rotating.

In a manner analogous to the differences between the first and second configuration, the third configuration and the fourth configuration have a difference. That is, with the structure of the third configuration, the handle member must be positioned in such a manner that the locking plug grooves 39*a*, 39*b* correspond with the radial bore 56 of the locking arm body as the actuator is rotated from the locked configuration to the unlocked configuration. Otherwise, the balls will be precluded from extending into the locking plug grooves 39*a*, 39*b*, and, the actuator will be precluded from further rotation.

On the other hand, with the fourth configuration, if the locking plug grooves 39*a*, 39*b* are not in a position where they line up (or correspond) to the radial bore, the actuator will cease rotating, however, the second cam can continue to rotate, which will impart rotation to the spring to load the same. Thus, the second cam can complete the entire movement from the locked configuration to the unlocked configuration (regardless of the position of the handle). When the handle assembly is rotated so that the locking plug grooves 39*a*, 39*b* correspond to the radial bore, rotation of the actuator is no longer precluded by the balls, and the stored energy in the spring is directed to the actuator, rotating the same, and driving the balls into the respective one of the locking plug grooves 39*a*, 39*b*.

It will be understood that variations are contemplated. That is, variations can be made to the configuration of the cam surfaces and the follower surfaces to provide for a differently directed movement. In other configurations, a single outward locking plug (i.e., ball) can be utilized. In still other configurations, more than two balls can be utilized (with additional corresponding radial bores and further locking plug grooves). Other variations are likewise contemplated as being within the scope of the present disclosure.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A lock comprising:

a handle assembly having:

a handle member having a central bore and at least one transverse groove extending outwardly from the central bore; and a lock assembly having:

a lock arm with a body and an actuator leg extending axially from the body, the body having a central bore with at least one radial bore extending outwardly therefrom, the body positionable within the central bore of the handle member;

at least one outward locking plug configured to travel along the at least one radial bore of the lock arm and into the at least one transverse groove of the handle member upon alignment of the at least one radial bore and the at least one transverse groove;

a lock actuating assembly including:

an actuator positionable within the central bore of the body of the lock arm at least as far as the at least one radial bore of the body of the lock arm, and positionable relative to the body of the lock arm between an unlocked configuration, wherein the handle member and the lock arm rotate together, and a locked configuration, wherein the handle member is rotatable relative to the lock arm;

one of a slider and a second rotating cam associated with the actuator, and configured to selectively position the actuator between the locked and unlocked configurations, and having a first cam profile;

a cam having a first follower configured to intermittently coact with the first cam profile to move the one of the slider and the second rotating cam so as to selectively position the actuator between the locked and unlocked configurations upon the rotation of the cam, with the cam configured to continue rotating after the first follower has intermittently coacted with the first cam profile, thereby positioning the actuator in either one of the locked and unlocked configurations; and a motor having an axle extending therefrom and directly rotatably coupled to the cam so as to have the same axis of rotation, whereupon actuation of the motor causes rotation of the axle and the cam.

2. The lock of claim 1 wherein the one of the slider and the second rotating cam comprises a slider, configured to slidably travel and to selectively slide the actuator within the central bore of the lock arm.

3. The lock of claim 1 wherein the actuator includes a proximal end and a distal end, with the proximal end affixed to the slider.

4. The lock of claim 1 wherein the actuator includes a proximal end and a distal end, with the proximal end slidably coupled to the slider such that the slider and the actuator have relative movement therebetween, with a spring biasing the actuator away from the slider.

5. The lock of claim 4 wherein the slider includes a cavity, with the proximal end of the actuator positioned within the cavity and configured to move relative to the slider across the cavity.

6. The lock of claim 1 wherein the at least one outward plug comprises a pair of outward locking plugs, the at least one transverse groove comprises a pair of transverse grooves, and the at least one radial bore comprises a pair of radial bores.

7. The lock of claim 6 wherein each of the pair of outward locking plugs comprises a ball.

8. The lock of claim 1 wherein the one of a slider and a second rotating cam comprises the second rotating cam.

9. The lock of claim 8 wherein the second rotating cam is affixed to the actuator.

10. The lock of claim 8 wherein the second rotating cam is roatatable relative to the actuator, with a biasing member coupling the second rotating cam and the actuator.

11. The lock of claim 1 wherein the one of a slider and a second rotating cam comprises a slider, the slider further including a second cam profile disposed thereon, and the cam further includes a second follower configured to engage the second cam profile.

12. The lock of claim 11 wherein the first cam profile and the second cam profile are each substantially parallel to each other so as to define a longitudinal channel therebetween, the cam further including a body having a first side and a second side, the first follower extending from the first side of the body, and the second follower extending from the second side of the body, wherein the first follower interfaces with the first cam profile, and the second follower interfaces with the second cam profile, with the body of the cam positioned at least partially within the longitudinal channel.

13. The lock of claim 12 wherein the longitudinal channel defines an axis of slidable movement of the slider.

* * * * *